US007480945B2

(12) United States Patent
Knuth et al.

(10) Patent No.: US 7,480,945 B2
(45) Date of Patent: Jan. 27, 2009

(54) GLOVE HAVING A CUFFED PORTION

(75) Inventors: Rosemary F. Knuth, Congers, NY (US); Ross Steven Randolph, Rockaway, NJ (US); Joseph C. Hourihan, Cedar Grove, NJ (US); Gerald Merovitz, Dover, DE (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 11/232,790

(22) Filed: Sep. 22, 2005

(65) Prior Publication Data

US 2006/0195965 A1 Sep. 7, 2006

Related U.S. Application Data

(60) Provisional application No. 60/630,169, filed on Nov. 22, 2004, provisional application No. 60/611,979, filed on Sep. 22, 2004.

(51) Int. Cl.
*A41D 19/00* (2006.01)

(52) U.S. Cl. ..... 2/162

(58) Field of Classification Search ..... 2/162, 2/170

See application file for complete search history.

(56) References Cited

U.S. PATENT DOCUMENTS

| | | | | |
|---|---|---|---|---|
| 5,809 | A | 9/1848 | Jones | 408/62 |
| 40,226 | A | 10/1863 | Atwood | 431/314 |
| 55,339 | A | 6/1866 | Moffatt | 425/202 |
| 95,467 | A | 10/1869 | Groves et al. | 172/660 |
| 95,498 | A | 10/1869 | Maxim et al. | 431/207 |
| 99,199 | A | 1/1870 | Ingersoll | 192/45.2 |
| 99,200 | A | 1/1870 | Jarboe | 220/574 |
| 99,401 | A | 2/1870 | Calahan | 178/41 |
| 99,402 | A | 2/1870 | Camp | 72/109 |
| 149,101 | A | 3/1874 | Conklin | 99/605 |
| 156,098 | A | 10/1874 | Meyer | 346/53 |
| 156,236 | A | 10/1874 | Richards | 74/1 |
| 161,447 | A | 3/1875 | Schwamb | 144/225 |
| 161,753 | A | 4/1875 | Cary | 74/84 |
| 162,000 | A | 4/1875 | Woolf | 292/67 |
| 162,180 | A | 4/1875 | Maxwell et al. | 72/414 |
| 162,729 | A | 4/1875 | Wheeler | 301/129 |
| 162,732 | A | 4/1875 | Wilmot | 72/202 |
| 162,954 | A | 5/1875 | Russell | 229/5.7 |
| 180,656 | A | 8/1876 | Scutt | 256/6 |
| 180,733 | A | 8/1876 | Small, Jr. | 182/104 |

(Continued)

FOREIGN PATENT DOCUMENTS

| | | |
|---|---|---|
| EP | 824002 | 2/1998 |

(Continued)

*Primary Examiner*—Katherine Moran
(74) *Attorney, Agent, or Firm*—Ohlandt, Greeley, Ruggiero & Perle, L.L.P.

(57) ABSTRACT

The present invention provides a glove for a wearer. The glove has a hand covering portion and an arm covering portion connected to the hand covering portion. The arm covering portion has a number of segments with each connected to one another by a pivot. The arm covering portion in a first position covers and protects the wearer. The arm covering portion in a second position forms an obstruction to prevent a liquid from contacting the wearer with the obstruction trapping the liquid therein.

5 Claims, 33 Drawing Sheets

U.S. PATENT DOCUMENTS

| | | | | | |
|---|---|---|---|---|---|
| 181,194 | A | | 8/1876 | McCune | 164/13 |
| 205,925 | A | | 7/1878 | Truesdale | 126/31 |
| 214,126 | A | | 4/1879 | Gusman et al. | 292/57 |
| 221,364 | A | | 11/1879 | Ruger et al. | 366/193 |
| 223,330 | A | | 1/1880 | Finley et al. | 449/27 |
| 225,130 | A | | 3/1880 | Herbert et al. | 40/370 |
| 324,606 | A | | 8/1885 | Stoll | 280/47.18 |
| 393,336 | A | | 11/1888 | Kearney et al. | 122/97 |
| 395,536 | A | | 1/1889 | Ashton | 137/523 |
| 599,677 | A | | 3/1898 | Alden | 2/168 |
| 732,819 | A | | 7/1903 | Barnes | 132/73 |
| 1,157,646 | A | | 10/1915 | Miller | 2/168 |
| 1,302,038 | A | * | 4/1919 | Hayes | 2/59 |
| 1,407,658 | A | | 2/1922 | Kelly | 2/170 |
| 1,509,060 | A | | 9/1924 | Dodge | 2/168 |
| 1,534,208 | A | | 4/1925 | Gibson | 239/288 |
| 1,924,617 | A | | 8/1933 | Miller | 2/159 |
| 2,034,120 | A | | 3/1936 | Straus | 2/159 |
| 2,051,077 | A | | 8/1936 | Dowdall | 112/417 |
| 2,106,348 | A | | 1/1938 | Hall et al. | 2/168 |
| 2,117,417 | A | | 5/1938 | Hall et al. | 2/168 |
| 2,266,716 | A | | 12/1941 | Robertson | 2/168 |
| 2,314,922 | A | | 3/1943 | Chanut | 2/159 |
| 2,641,767 | A | | 6/1953 | La Rosa | 2/168 |
| 2,655,663 | A | | 10/1953 | Hoagland | 2/270 |
| 2,686,919 | A | | 8/1954 | De Grazia | 2/162 |
| 2,821,718 | A | | 2/1958 | Hall et al. | 2/162 |
| 3,009,164 | A | | 11/1961 | Frey | 2/270 |
| 3,025,403 | A | | 3/1962 | Belknap et al. | 250/516.1 |
| 3,110,035 | A | | 11/1963 | La Hue | 2/168 |
| 3,178,725 | A | | 4/1965 | Ross | 2/167 |
| 3,268,647 | A | | 8/1966 | Hayes et al. | 264/303 |
| 3,541,609 | A | | 11/1970 | Povlacs et al. | 2/168 |
| 3,555,564 | A | * | 1/1971 | Miskell et al. | 2/168 |
| 3,643,386 | A | | 2/1972 | Gryzll | |
| 3,681,784 | A | * | 8/1972 | Lindley | 2/162 |
| 3,747,126 | A | | 7/1973 | Hoagland | 27/10 |
| 3,867,727 | A | | 2/1975 | Povlacs | 2/167 |
| 4,069,913 | A | | 1/1978 | Harrigan | 206/278 |
| 4,099,270 | A | | 7/1978 | Jabour | 2/168 |
| 4,133,624 | A | | 1/1979 | Heavner et al. | 425/275 |
| 4,135,867 | A | | 1/1979 | Stockum | |
| 4,320,423 | A | | 3/1982 | Frey et al. | 360/72.2 |
| 4,389,734 | A | | 6/1983 | Franz et al. | 2/59 |
| 4,399,567 | A | | 8/1983 | Joong | 2/161 |
| 4,677,697 | A | | 7/1987 | Hayes | 2/159 |
| 4,757,557 | A | | 7/1988 | Hirano | 2/168 |
| 4,771,518 | A | | 9/1988 | LaPointe et al. | 28/143 |
| 4,788,733 | A | | 12/1988 | Lerner | 15/104.94 |
| 4,809,365 | A | | 3/1989 | Chen et al. | 2/168 |
| 4,845,781 | A | | 7/1989 | Strickland et al. | 2/161 |
| 4,918,754 | A | | 4/1990 | Leatherman et al. | 2/16 |
| 4,937,881 | A | | 7/1990 | Heise | 2/16 |
| 4,984,299 | A | | 1/1991 | Halldorsdottir | 2/16 |
| 5,020,159 | A | | 6/1991 | Hellickson | 2/158 |
| 5,070,544 | A | | 12/1991 | Aliberti et al. | 2/170 |
| 5,186,322 | A | | 2/1993 | Harreld et al. | 206/216 |
| 5,310,517 | A | | 5/1994 | Dams et al. | 264/255 |
| 5,459,879 | A | | 10/1995 | Fuchs | 2/161.7 |
| 5,483,697 | A | | 1/1996 | Fuchs | 2/161.7 |
| 5,704,670 | A | | 1/1998 | Surplus | 294/25 |
| 5,833,911 | A | | 11/1998 | Llort et al. | 264/301 |
| 6,092,237 | A | | 7/2000 | Baldwin | 2/161.7 |
| 6,128,785 | A | | 10/2000 | Sommeregger | 2/162 |
| 6,249,917 | B1 | | 6/2001 | Vrissimdjis et al. | 2/161.7 |
| 6,523,181 | B2 | | 2/2003 | Medves | 2/161.6 |
| 6,539,549 | B1 | | 4/2003 | Peters, Jr. | 2/16 |
| 2001/0034892 | A1 | | 11/2001 | Ferdig | 2/159 |
| 2002/0189007 | A1 | | 12/2002 | Cormier | 2/457 |
| 2003/0046748 | A1 | | 3/2003 | Tanenbaum | 2/209.13 |
| 2004/0148680 | A1 | | 8/2004 | Lehmann | |

FOREIGN PATENT DOCUMENTS

| | | |
|---|---|---|
| EP | 1002469 | 5/2000 |
| FR | 1508320 | 1/1968 |
| GB | 2099286 | 12/1982 |
| JP | 5230702 | 9/1993 |
| JP | 6173014 | 6/1994 |
| WO | WO 2008/036905 | 3/2008 |

* cited by examiner

GLOVE HAVING A CUFFED PORTION

CROSS REFERENCES TO RELATED PATENT APPLICATIONS

The present application is claiming priority of U.S. Provisional Patent Application Ser. No. 60/611,979 filed on Sep. 22, 2004 and U.S. Provisional Patent Application Ser. No. 60/630,169 filed on Nov. 22, 2004, with the entire contents of each incorporated by reference herein.

BACKGROUND OF THE INVENTION

1. Field of the Invention

The present invention relates to a glove for covering a hand and an arm of a wearer. More particularly, the present invention relates to a glove that has a cuffed or conical segment having a diameter wider than the glove itself. The cuffed or conical segment will create an obstruction to shield the wearer from being contacted by a liquid.

2. Description of the Related Art

Gloves having cuffs are known in the art. One such glove is disclosed in U.S. Pat. No. 6,249,917 B1 to Vrissimdjis. Vrissimdjis discloses a glove. The glove has a tubular sleeve portion and a cuff portion connected to the tubular sleeve portion. In use, the cuff portion folds over the tubular sleeve portion at a predetermined location to form a pocket. The pocket of the glove has a bead at the predetermined location of the glove. The bead is circular in cross section and juts outward from the tubular sleeve portion of the glove toward the cuff portion. The bead thus permits the cuff portion to have a stable shape in the folded over position over the tubular sleeve portion, and further permits the cuff portion to remain folded over the tubular sleeve portion and not become disturbed upon the movement of the glove.

The glove of the prior art is deficient in its operation. The inventor has found that through consumer testing the glove of Vrissimdjis has a cuff portion that is difficult to maintain in a cuffed shape. Also, the glove of Vrissimdjis results in becoming easily unfolded and liquid escaping from the cuffed portion and contacting the wearer.

The cuff portion of the glove of Vrissimdjis is difficult to hold in a cuffed position due to the overall dimensions or size, shape, and weight of the glove. For example, if a consumer touches the cuffed portion at an edge of, for example, a dishwasher, the cuffed portion will become undone and liquid may contact the wearer. Also, the cuffed portion of Vrissimdjis is generally awkward, and, thus, not comfortable when worn in the cuffed portion.

Accordingly, there is a need for a glove with a cuff portion that eliminates one or more of the aforementioned drawbacks and deficiencies of the prior art.

SUMMARY OF THE INVENTION

It is an object of the present invention to provide a glove having a cuff portion that can easily be applied and removed from the wearer and does not easily become disengaged from a cuffed position.

It is another object of the present invention to provide a glove having a cuff portion and an arm covering portion to protect a wearer's arm from liquid.

It is still another object of the present invention to provide a glove that has a cuff portion that is conical.

It is yet another object of the present invention to provide a glove having a cuff portion that is formed from an arm covering portion.

It is a yet still another object of the present invention to provide a glove with a cuff portion that can be easily and quickly be manufactured in a cost effective manner.

It is a further object of the present invention to provide a glove having a cuff portion and an arm covering portion that has a number of segments.

It is a yet further object of the present invention to provide a glove having a cuff portion and an arm covering portion that has a number of segments that form the cuff portion in one position and then cover the arm in another or second position.

It is still yet a further object of the present invention to provide a glove having a cuff portion made from a first segment, a second segment, and a third segment that are manufactured from a suitable glove material.

It is still yet a further object of the present invention to provide a glove having a cuff portion made from a first segment, a second segment, and a third segment with the first through third segments each being connected to one another at a pivot.

It is still another object of the present invention to provide a glove having a cuff portion made from a first segment, a second segment, and a third segment with the first through third segments each being connected to one another at a pivot with the pivot being a portion of the glove having a reduced thickness or an enlarged thickness relative to each of the first through third segments.

These and other objects and advantages of the present invention are achieved by a glove for a wearer according to the present invention. The glove has a hand covering portion and an arm covering portion connected to the hand covering portion with the arm covering portion having a number of segments. Each segment is connected to one another by a pivot. The arm covering portion in a first position covers and protects the wearer. The arm covering portion in a second position forms an obstruction. The obstruction obstruct a path of a liquid from contacting the wearer and traps the liquid therein.

DETAILED DESCRIPTION OF THE INVENTION

Figure 1:
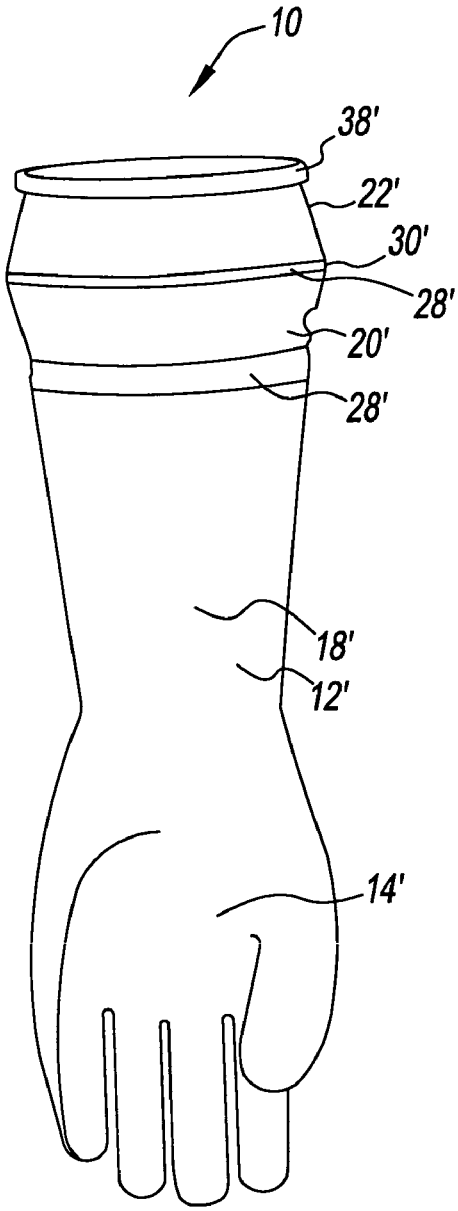
FIG. 1 is a top view of a glove having a cuff portion of the present invention with the glove being in a first position.

Referring to the drawings and, in particular, to FIG. 1, there is shown a glove of the present invention generally represented by reference numeral 10. The glove 10 is advantageous because the glove covers both the hand and arm and forms an obstruction to prevent liquid from contacting the wearer. The glove 10 also traps liquid therein in an advantageous manner to prevent the liquid from contacting the wearer. The liquid may be water, paint, solvent, liquid including one or more additives, harmful liquid substances, or any other liquid material known in the art.

The glove 10 has an arm covering portion 12' and a hand covering portion 14'. The hand covering portion 14' preferably has a number of finger coverings and a thumb covering. The finger coverings and the thumb covering protect the wearer's hand and digits. In one embodiment, the arm covering portion 12' preferably can be made in a number of different sizes, such as small, medium, large and extra-large, to accommodate a number of differently-sized users as is known in the art. The arm covering portion 12' is preferably firmly connected to, and most preferably integral with, the hand covering portion 14'. This connection prevents any liquid from entering any part of the glove 10.

The arm covering portion 12' is generally tubular in shape. The arm covering portion 12' preferably is made from a number of segments 16'. One skilled in the art should appreciate that any number of segments 16' may be used with and is within the scope of the present invention, and the invention is in no way limited to the number of segments disclosed herein. In a preferred embodiment, each of the number of segments 16' is generally a cylindrical, or a tubular shaped member. Preferably, each segment 16' is made from latex, rubber, neoprene, polyvinyl chloride, nitrile vinyl, any moldable material known in the art, or any other water impervious material known in the art, or any combinations thereof.

In a preferred embodiment of the present invention, the number of segments 16' are a first segment 18', a second segment 20', and a third segment 22'. The first segment 18' preferably covers the arm of the wearer. The first segment 18' is connected to the second segment 20' at a side 24'. The first segment 18' has the same sized diameter at the side 24' as the second segment 20'. This same size is for mating the first segment 18' to the second segment 20' as shown. The side 24' preferably has a first pivot or hinge 26'. The first pivot 26' is preferably a hinge torsion band. The hinge torsion band 26' preferably curves inward or outwardly at a lateral side thereof.

The second segment 20' is preferably connected to the third segment 22' at a second side 28'. At the second side 28', the second segment 20' has the same sized diameter as the third segment 22'. The glove 10 has a second pivot or second hinge 30'. The second pivot 30' is between the second segment 20' and the third segment 22'. The second pivot 30' is preferably a hinge point. The second pivot 30' is manufactured by a gauge change of the material forming the glove 10. Both the first pivot 26' and the second pivot 30' are preferably each a dimension change that is slightly different that a remainder of the glove 10. The first pivot 26' and the second pivot 30' could be a thicker portion, a thinner portion, a change in a shape of the glove 10, a pattern or a different material that the remainder of the glove with the different material deposited, manually attached, or molded thereon to facilitate pivoting.

Figure 2:
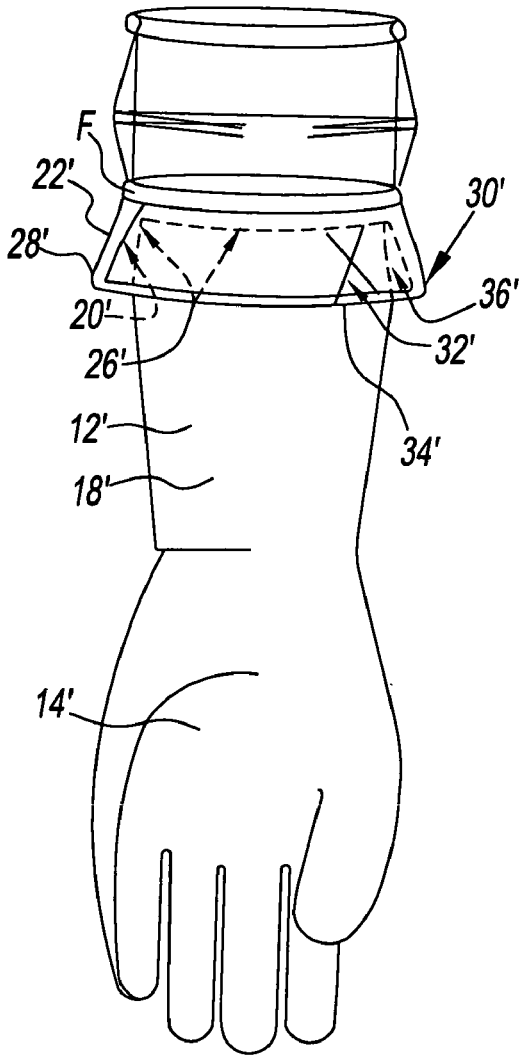
FIG. 2 is another top view of the glove of FIG. 1 in a second position, with a second segment and a third segment of the glove forming the cuff portion for trapping liquid.

Referring still to FIG. 1, the glove 10 is shown in a first position or covering both the arm and hand of the wearer. Referring to FIG. 2, when a force F is imparted on the third segment 22', the glove 10 will be manipulated to a second position. The second position is where the glove 10 has a cuff portion 32'. The cuff portion 32' prevents liquid from flowing past the cuff portion on the arm of the wearer. The cuff portion 32' preferably is a substantially conical shaped member that has an outer edge 34'. The outer edge 34' is the second hinge 30' of FIG. 1 in a folded position. In the second position as shown in FIG. 2, the glove 10 has the third segment 22' folded over the second segment (not shown) so the second segment is substantially in a position under the third segment. The outer edge 34' preferably is pointed in a direction toward the hand covering portion 14' of the glove 10. The cuff portion 32' forms a space 36' shown in dotted lines between the cuff portion 32' and the first segment 18' of the glove 10. In this manner, the second segment 20' (being shown under the third segment 22') and the third segment both collectively cooperate and form the cuff portion 32'.

The cuff portion 32' obstructs liquid flow in a direction from the hand covering portion 14' to the arm covering portion 12'. More particularly, liquid that runs from the hand covering portion 14' to the arm covering portion 12' will not contact the wearer at an end of the glove 10, and instead will be collected in, and thus obstructed by, the space 36'. The space 36' has a volume. The volume is suitable for holding an amount of liquid therein.

The second segment 20' and the third segment 22' preferably have a complementary size relative to one another to evenly fold over one another and form the cuff portion 32'. The second segment 20' and third segment 22' have a suitable thickness so as not to tear while pulled with force F. The second segment 20' and the third segment 22' are durable and resilient to hold in the second position and retain the form of the cuff portion 32' as desired and not become accidentally dislodged and unfolded. Connected to the glove 10 at an end thereof is a trap 38' shown in FIG. 1. The trap 38' is preferably a bead trap. The bead trap 38' is another member that is separate from the glove 10. The bead trap 38' collects excess liquid therein. The bead trap 38' assists the cuff portion 32' in directing a predetermined amount of liquid in a direction away from the glove 10. The bead trap 38' stops the liquid and redirects a flow of the liquid. As shown in FIG. 1, the glove 10 optionally may be manufactured with the rolled bead portion 38' at an end of the third segment 22', as shown in FIG. 1.

Figure 3:
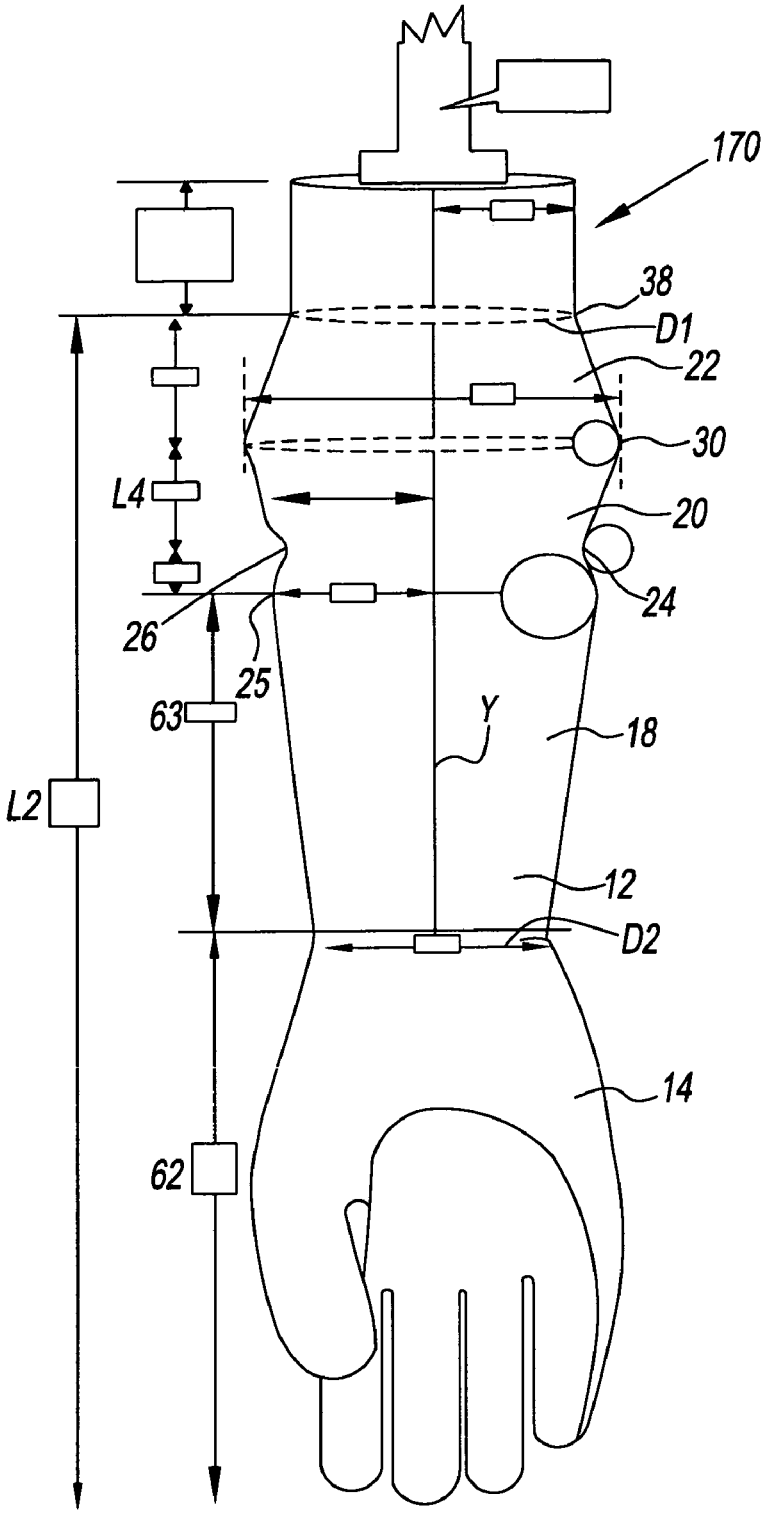
FIG. 3 is a glove forming device connected to a hook for dipping the device into a glove making material and for manufacturing the glove of FIG. 1.

Referring to FIG. 3 that shows a forming device 170, the device or former is dipped in the glove making material for forming the glove 10 having complementary dimensions and a complementary shape as the forming device 170. The forming device 170 has the first segment 18, the second segment 20, the third segment 22, and the hand covering portion 14. The length l1 of the glove 10 preferably is about 14 inches. The length l2 of the hand covering portion 14 preferably is about 7.5 inches. The hand covering portion 14 preferably has a diameter D2 of about 2.4 inches. The first segment 18 preferably has a length l3 of about 4 inches. The side 24 to a largest diameter 25 of first segment 18 preferably is about 0.5 inches and has a radius of curvature of about 0.5 inches. The largest diameter 25 preferably is about 2.64 inches. The first hinge preferably curves inward toward a longitudinal axis Y of the glove 10 and has a radius of curvature of about 0.25 inches. The side 24 and the second hinge 30 preferably has a length l4 of about 1.25 inches. The second hinge 30 preferably has a length l5 to the bead trap 38 of about 1.5 inches. The second hinge 30 preferably has a radius of curvature of about 0.25 inches and a diameter of about 4 inches. The bead trap 38 preferably has an inner diameter D1 of about 3 inches. Various configurations are possible and within the scope of the present invention.

Figure 4:
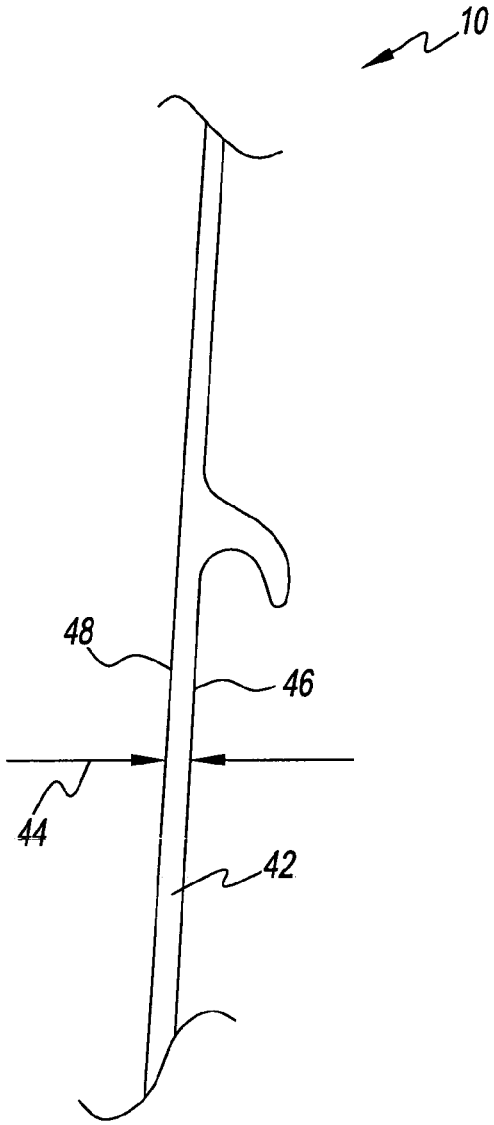
FIG. 4 is a cross sectional view of a second embodiment of a cuffed portion of the glove with the glove being cut along a longitudinal axis of the glove.

Referring to FIG. 4, another embodiment of the glove 10 has an outer wall 42 that has a thickness 44. The outer wall 42 has an exterior side 46 and an interior side 48. The exterior side 46 preferably faces in a direction opposite the wearer. The interior side 48 is opposite the exterior side 46 and contacts the wearer. Disposed integral with the exterior side 46 of the glove 10 is a wall 50. The wall 50 is preferably made from the same material as the outer wall 42. The wall 50 extends around a cylindrical periphery of the glove 10. Alternatively, the wall 50 may be made from a different material than the outer wall 42, and connected thereon.

Preferably, the wall 50 is an arcuate member, and is a permanent hook member. The wall 50 curves in a direction toward the hand covering portion 14 of the glove 10 as shown in FIGS. 1 through 3. Preferably, the wall 50 is formed by a corresponding indentation or reservoir located in a complementary mold. This indentation fills when material for forming the glove 10 is introduced into the mold. The wall 50 preferably could be placed anywhere from a location immediately above the fingers or toward the opening thereof.

Figure 5:
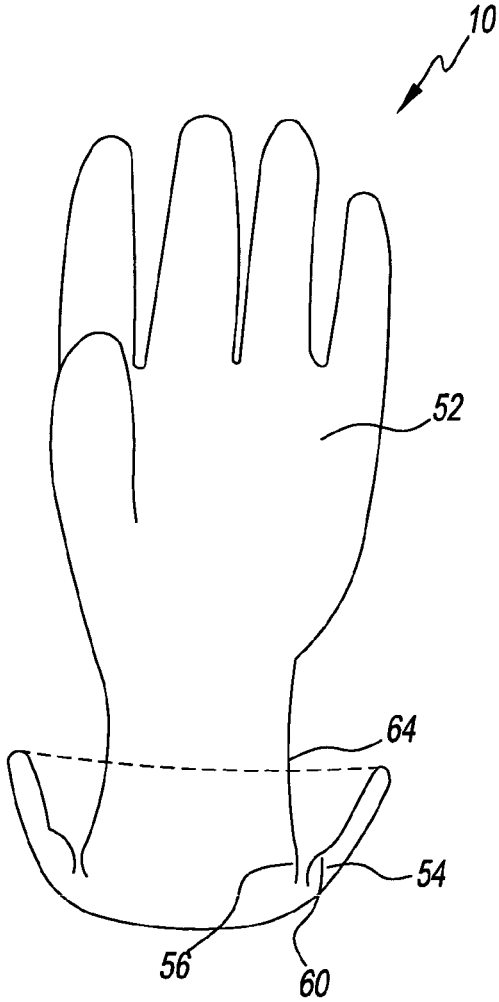
FIG. 5 is a top view of a third embodiment of a cuffed portion of the glove.

Referring to the FIG. 5 embodiment, the glove 10 preferably has a hand covering portion 52 and a cuff portion 54. The cuff portion 54 preferably is the same material as the hand covering portion 52 and is pulled over a portion of the hand covering portion. The cuff portion 54 is connected to the hand covering portion 52 to trap an amount of water therein and thus deflect liquid from contacting the wearer's arm.

The hand covering portion 52 preferably has a first protrusion 56. The first protrusion 56 is in a first location of the glove 10. The first protrusion 56 preferably has a first height 58. The first protrusion 56 is most preferably a ring structure that extends around the glove 10. The cuff portion 54 preferably has a second protrusion 60. The second protrusion 60 preferably has a second height 62 and is spaced a predetermined distance away from the first protrusion 56. The second height 62 is about the same or different than the first height 58. The second protrusion 60 is in a complementary location relative to the first protrusion 56. Thus, the second protrusion 60 contacts the first protrusion 56 when the cuff portion 54 is over the hand covering portion 52, or in the second position. In this manner, the cuff portion 54 is propped opened and away from an exterior side 64 of the glove 10.

Preferably, the first protrusion 56 contacts the second protrusion 60 to prop the cuff portion 54 a predetermined distance away from the exterior side 64. The first protrusion 56 and the second protrusion 60 act as a fold indicator or line. The fold indicator shows the wearer where to fold the glove 10 to form the cuff portion 54. Preferably, when the first protrusion 56 contacts the second protrusion 60, the wearer will know or otherwise perceptibly recognize the fold line. The first protrusion 56 and the second protrusion 60 are preferably applied separately to the glove 10 or molded with the glove and may be each a different or the same material as the remainder of the glove 10.

Most preferably, the first protrusion 56 and the second protrusion 60 are both formed as integral members with the glove 10. The first protrusion 56 and the second protrusion 60 are preferably molded with the glove 10. One skilled in the art should appreciate that the first protrusion 56 and the second protrusion 60 may be formed as a first continuous ring or band and a second continuous ring. Each ring has a constant size measured around the periphery of the glove 10 and each is disposed on the exterior side 64 and extends around an outer periphery of the glove 10, or alternatively around a portion of the outer periphery of the glove. In another embodiment, each ring may be formed as a non-continuous ring or band or segmented band with a number of spaces therebetween. The first protrusion 56 may be thicker than the second protrusion 60. Alternatively, the second protrusion 60 may be thicker than the first protrusion 56 for comfort.

Figure 6:
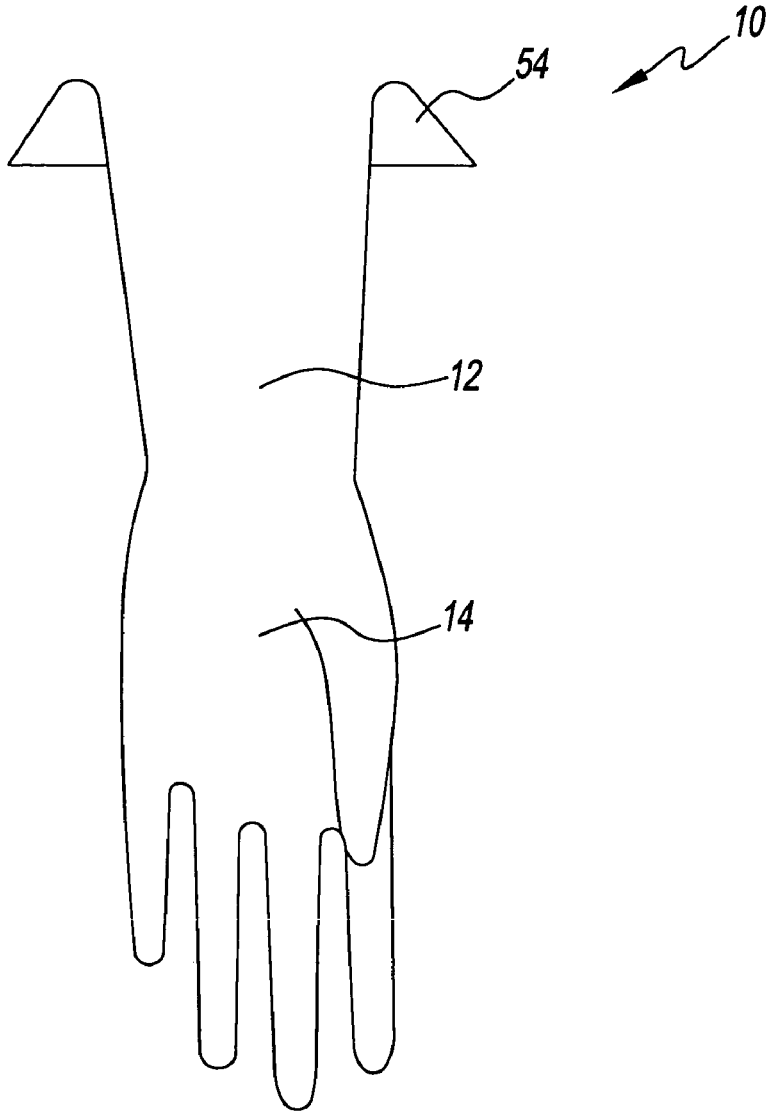
FIG. 6 is a top view of another or fourth embodiment of a cuffed portion of the glove.
Figure 6A:
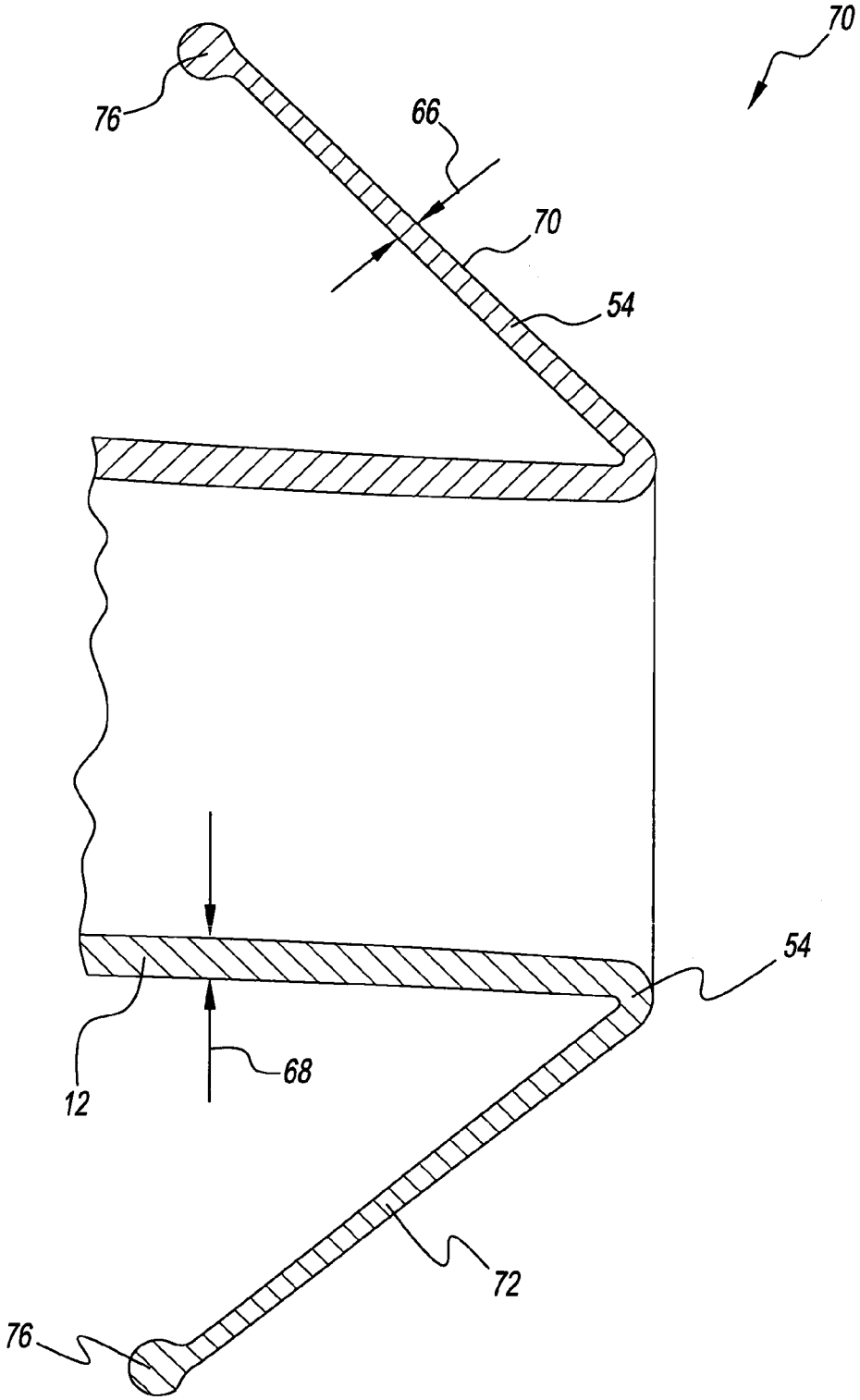
FIG. 6A is a cross sectional view of a fourth embodiment of a cuffed portion of the glove of FIG. 6.

The fourth embodiment of the glove 10 indicates to the wearer a location where to fold the glove 10 to form the cuff portion 54. Referring to FIGS. 6 and 6A, the cuff portion 54 has a first thickness 66, and the arm covering portion 12 has a second thickness 68. Preferably in this embodiment, the second thickness 68 is greater than the first thickness 66. The difference from the first thickness 66 to the second thickness 68 is a detector. The difference gives the wearer a tactile feedback to detect a predetermined location where to fold the cuff portion 54 relative to the arm covering portion 12.

Also, the cuff portion 54 has a first arm 70 and a second arm 72. The first arm 70 and the second arm 72 both are connected to the arm covering portion 12. The first arm 70 and the second arm 72 are connected at a base 74 thereof adjacent to an opening of the glove 10. The first arm 70 is preferably disposed at an angle relative to a lateral side of the arm covering portion 12. Preferably, the angle is in a range that includes about forty-five degrees. However, the angle may vary to render a wider cuff portion 54. The angle may be less than ninety degrees, less than forty-five degrees but preferably about forty-five degrees. An outer edge of the cuff portion 54 has a bulbous member 76 connected thereto. The bulbous member 76 preferably is optional and is a rolled bead to provide structural integrity to the cuff portion 54. Alternatively, the cuffed portion 54 may be the same thickness as the arm covering portion 12. In this alternative embodiment, an intersection is between the cuffed portion 54 and the arm covering portion 12 has a thickness (larger or smaller) that is different than both the arm covering portion 12 and the cuffed portion 54 to provide a fold indicator. Alternatively, the fold indicator may be a pattern.

Figure 7:
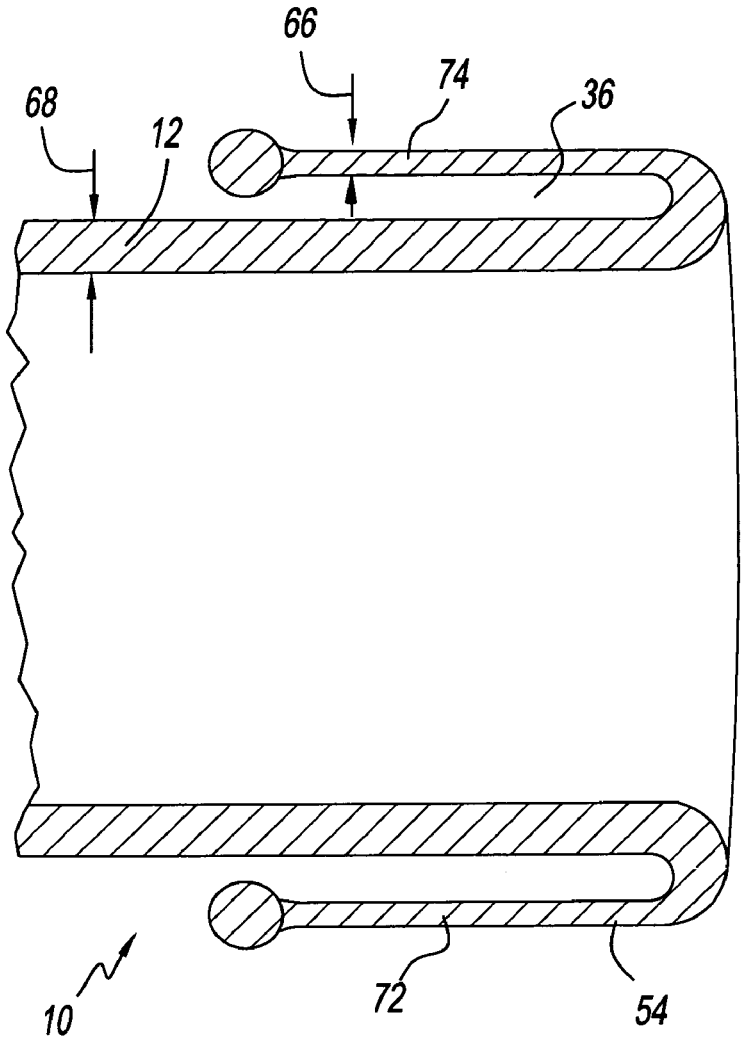
FIG. 7 is a cross sectional view of a fifth embodiment of a cuffed portion of the glove.
Figure 7A:
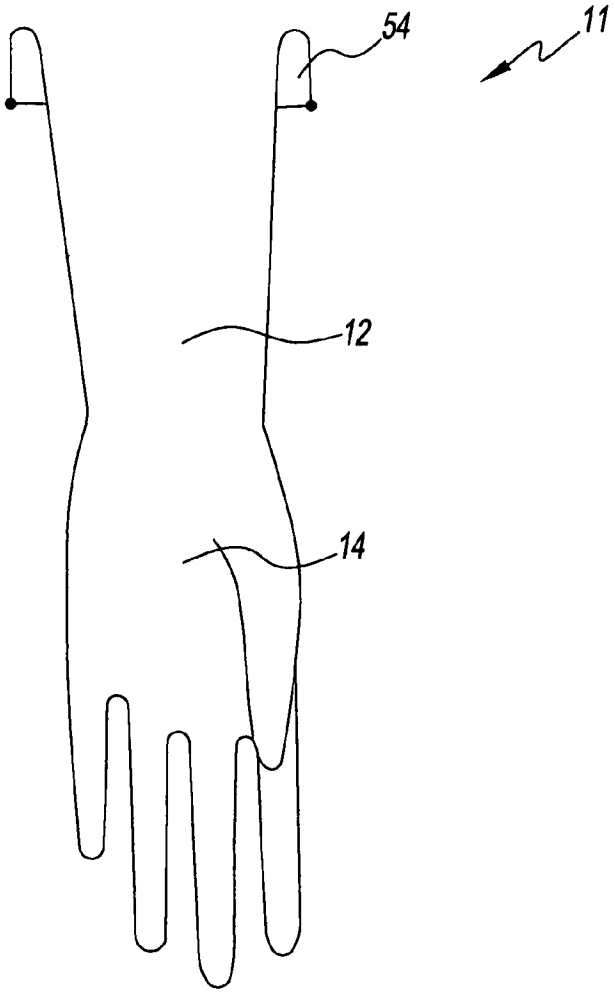
FIG. 7A is a top view of the fifth embodiment of the cuffed portion of the glove of FIG. 7.

FIG. 7 shows a fifth embodiment of the cuffed portion of the glove 10 in which the first arm 72 and the second arm 74 of the cuff portion 54 are preferably substantially adjacent to the arm covering portion 12 to form the space 36 therebetween for allowing liquid to collect therein. Again, the noticeable thickness difference from the first thickness 66 to the second thickness 68 gives the wearer a tactile feedback as to the location where to fold the cuff portion 54 relative to the arm covering portion 12. Referring to FIG. 7A, the cuff portion 54 preferably is disposed at an angle relative to an outer plane that is parallel to the outer surface of the arm covering portion 12. This angle is variable and may be less than ninety degrees as shown, preferably an acute or narrow angle, less than forty-five degrees, or at about forty degrees.

Figure 8:
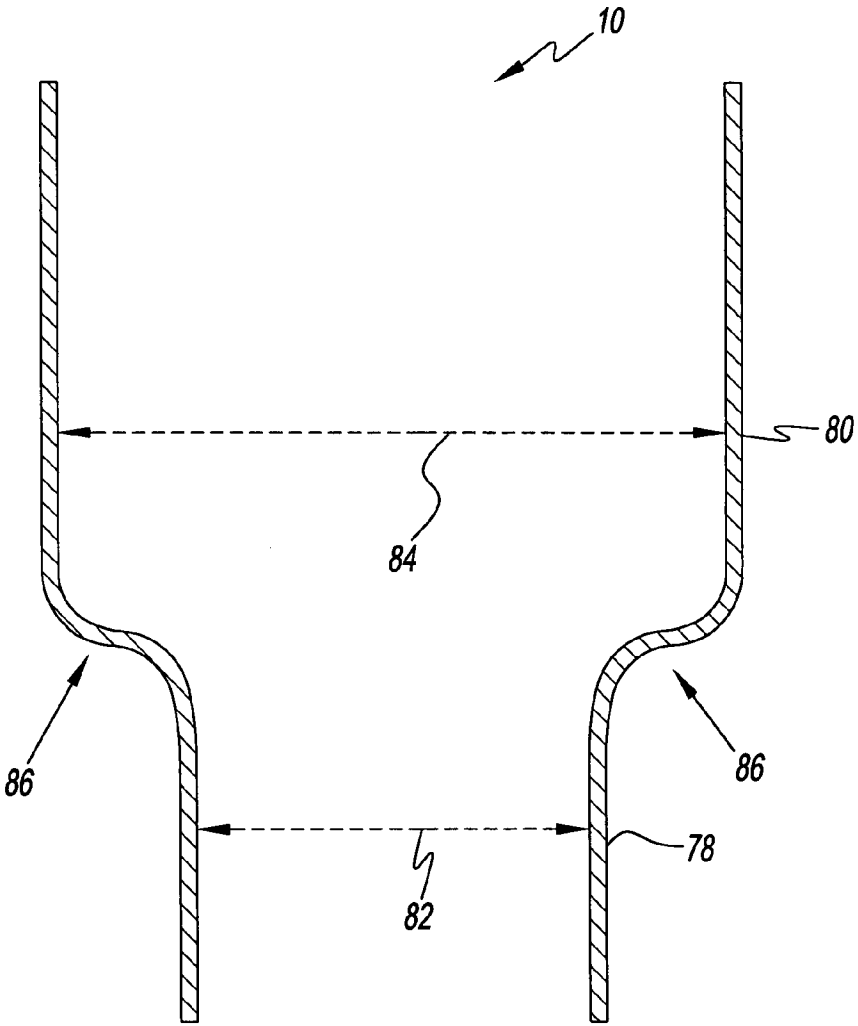
FIG. 8 is a view of a sixth embodiment of a cuffed portion of the glove with the view being cut through a longitudinal axis of the glove.

FIG. 8 shows a sixth embodiment of the cuffed portion of the glove 10. The glove 10 preferably has a first tubular section 78 and a second tubular section 80. Preferably, the first tubular section 78 has a first diameter 82 and is connected to the second tubular section 80. The second tubular section 80 preferably has a second diameter 84 that is greater than the first diameter 82 to form an exterior edge 86. The exterior edge 86 of the second tubular section 80 preferably extends outwardly therefrom. The exterior edge 86 obstructs liquid. In this manner, any liquid that traverses from the hand covering portion 14 will contact the exterior edge 86 of the second tubular section 80 and deflect outwardly from the glove 10. This exterior edge 86 also acts as a fold indicator to assist the wearer with a location where to fold the glove 10. The first tubular section 78 and the second tubular section 80 form an angle relative to one another. This angle can vary and be 90 degrees or higher or any angle in the art so long as the exterior edge 86 acts as the fold indicator to assist the wearer with a location where to fold the glove 10.

Figure 9:
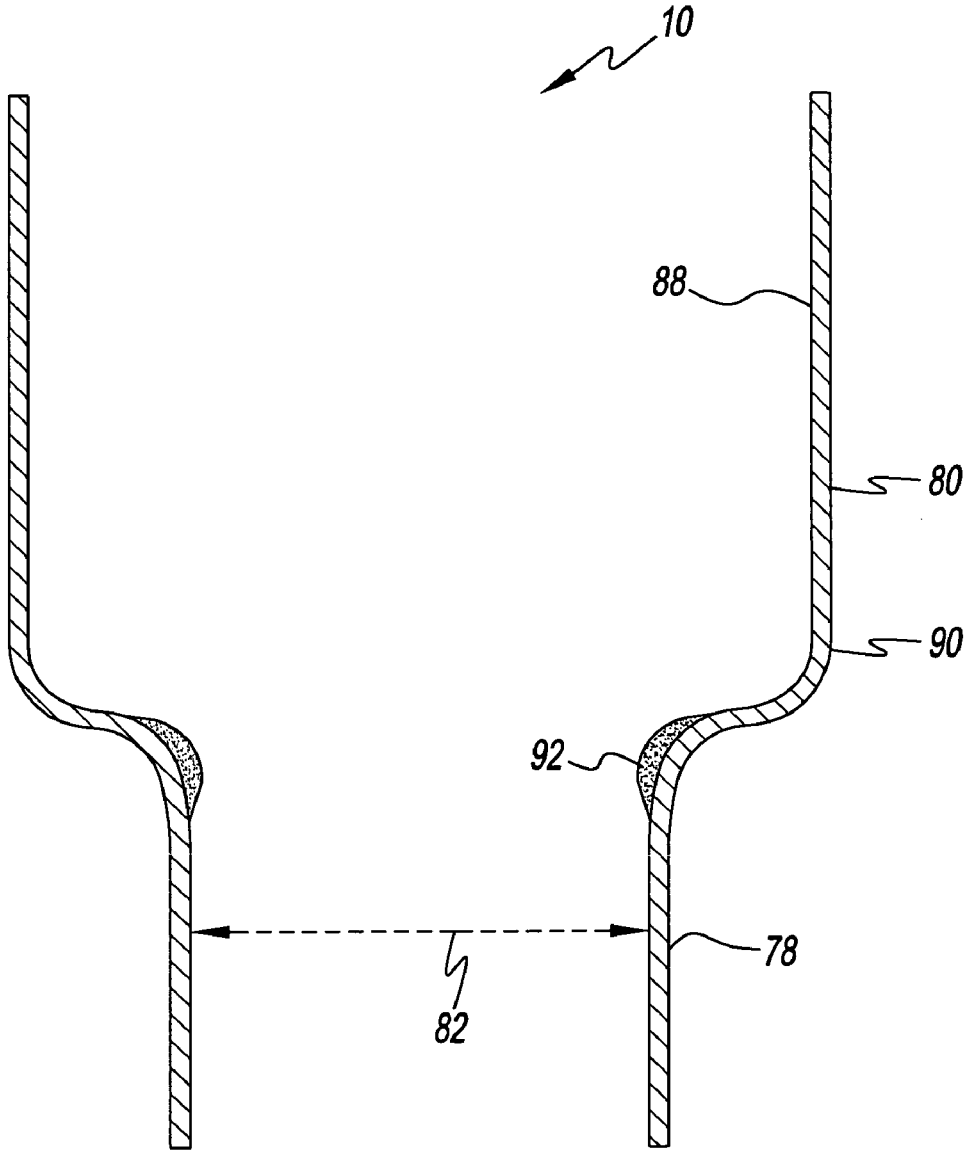
FIG. 9 is a view of a seventh embodiment of a cuffed portion of the glove with the view being cut through a longitudinal axis of the glove.

FIG. 9 shows a seventh embodiment of the cuffed portion of the glove 10. In this embodiment, the glove 10 preferably has an interior surface 88 and an exterior surface 90. Disposed on the interior surface 88 at a location between the second tubular section 80 and the first tubular section 78 is a protrusion 92. The protrusion 92 is two members. Each member is a substantially polygonal member, and is connected at an intersection preferably between the first tubular section 78 and the second tubular section 80. The first protrusion 92 reduces the first diameter 82 or overall width of the first tubular section 78. This width reduction allows the wearer's arm to fit snugly therein. The first protrusion 92 may be in any suitable location on the glove 10 and acts as a stop member or tactile feedback for providing a fold indicator as to an acceptable position of the cuff portion 54. Again, the angle between the first tubular section 78 and the second tubular section 80 can vary, and can be slightly below ninety degrees, at ninety degrees or higher to assist the wearer with a location where to fold the glove 10.

Figure 10:
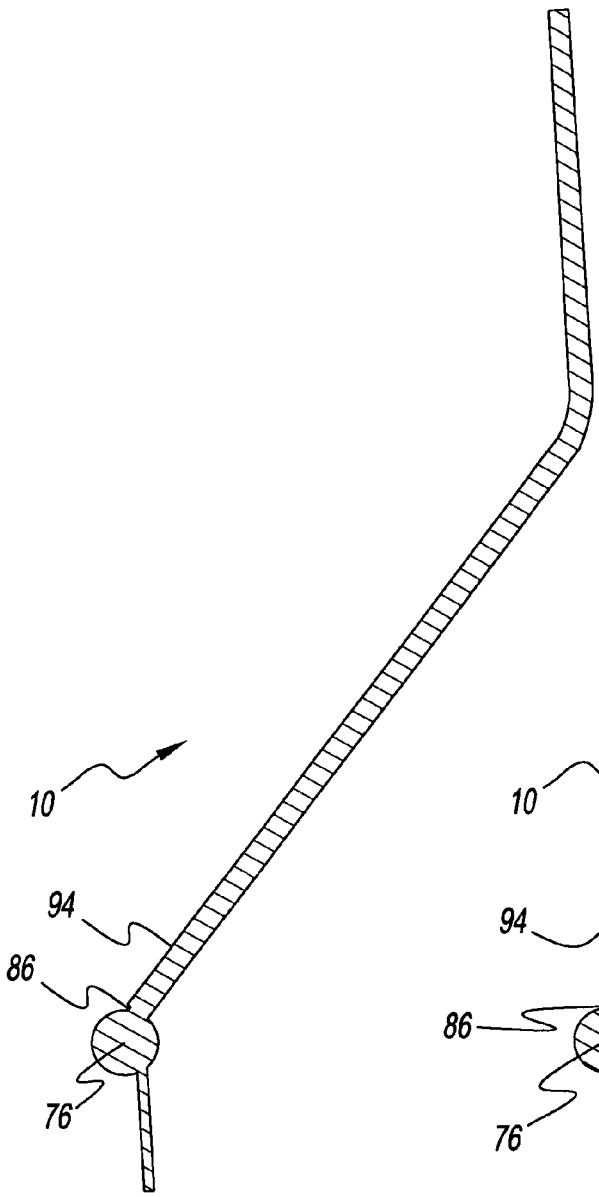
FIG. 10 is a view of an eighth embodiment of a cuffed portion of a glove with the view being cut through a longitudinal axis of the glove.

FIG. 10 shows an eighth embodiment of the cuffed portion of the glove 10. In this embodiment, the glove 10 has the bulbous member 76. The bulbous member 76 is on a lateral side 94 of the glove 10 at a location adjoining the exterior edge 86. Preferably, the bulbous member 76 provides structural integrity to the glove 10. The bulbous member 76 acts as a tactile feedback for providing a fold indicator as to an acceptable position of the cuff or cuff portion.

Figure 11:
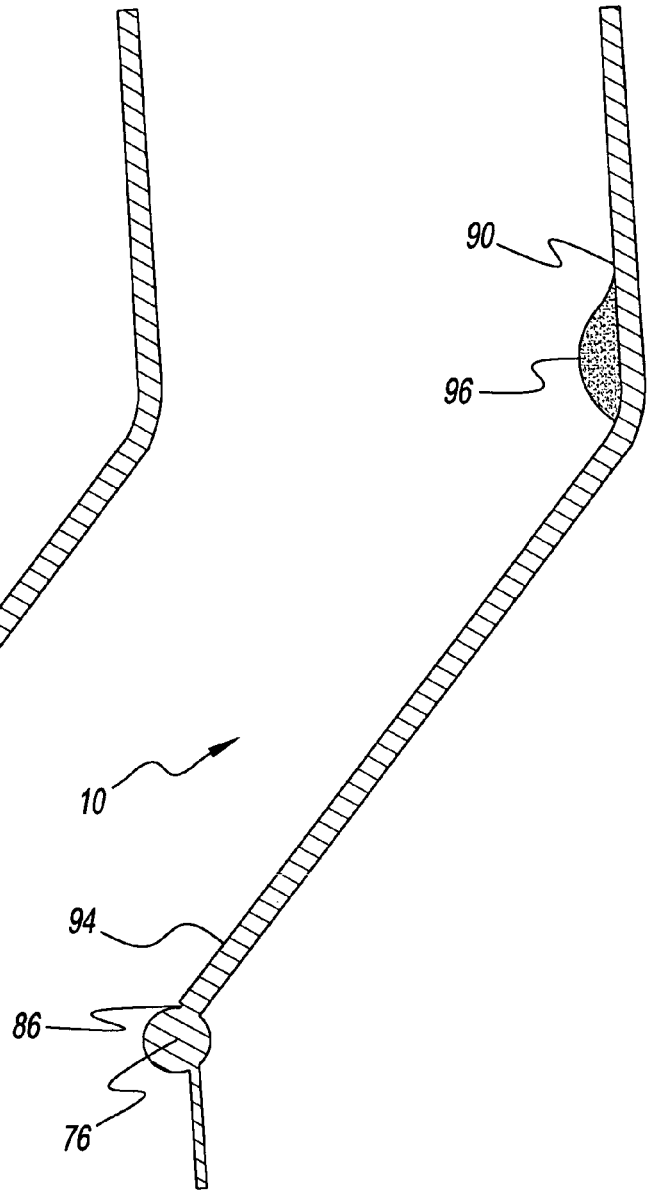
FIG. 11 is another view of a ninth embodiment of a cuffed portion of the glove with the view being cut through a longitudinal axis of the glove.

FIG. 11 shows a ninth embodiment of the cuffed portion of the glove 10. The glove 10 preferably has a third protrusion 96. The third protrusion 96 is on the lateral side 94 of the glove 10. Preferably, the third protrusion 96 has a height and is raised relative to a remainder of the exterior surface 90. The third protrusion 96 acts as a tactile feedback for providing a fold indicator as to an acceptable position of the cuff or cuff portion.

Figure 12:
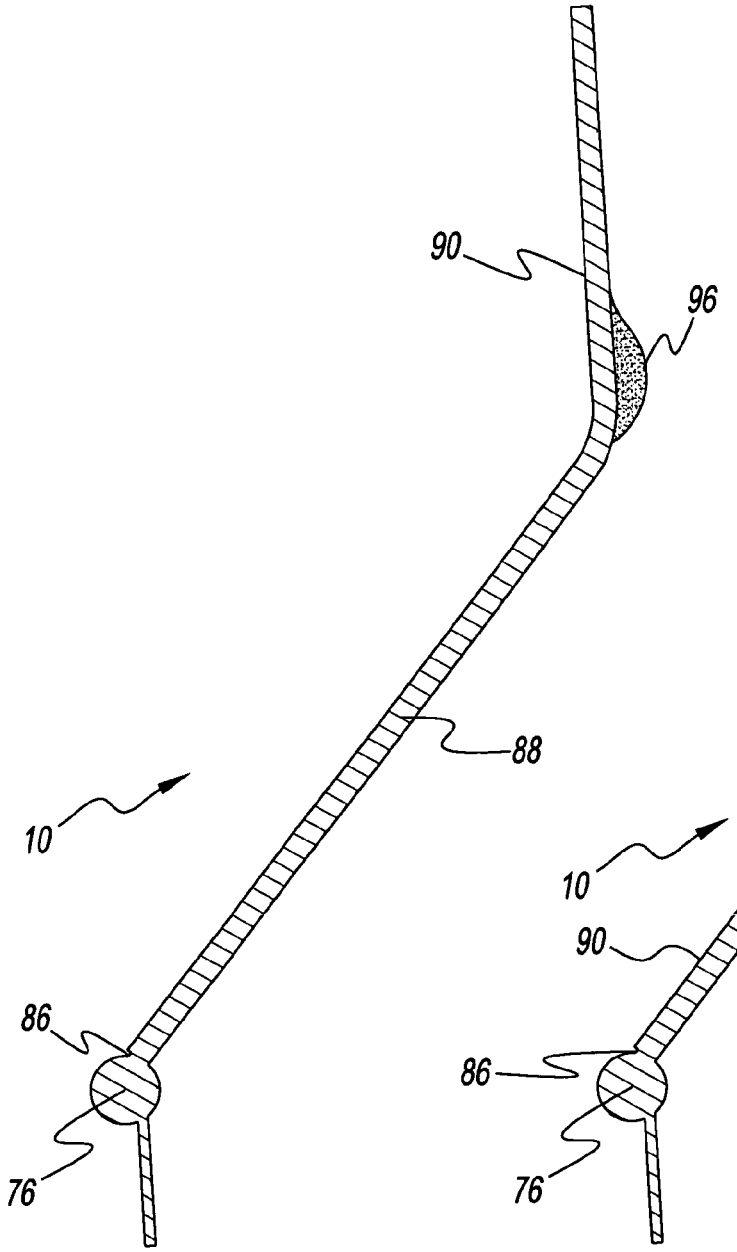
FIG. 12 is another view of a tenth embodiment of a cuffed portion of the glove with the view being cut through a longitudinal axis of the glove.

FIG. 12 shows a tenth embodiment of the cuffed portion of the glove 10. The glove 10 preferably has the third protrusion 96 in a different location than that of FIG. 11. The third protrusion 96 is on the interior surface 88 of the first tubular section 78. Preferably, the third protrusion 96 contacts the wearer's skin. The third protrusion 96 raises a predetermined complementary portion of the exterior surface 90 relative to a remainder of the exterior surface. This raised exterior surface 90 thus acts as the tactile feedback for providing the fold indicator as to the acceptable position of the cuff or cuff portion 54.

Figure 13:
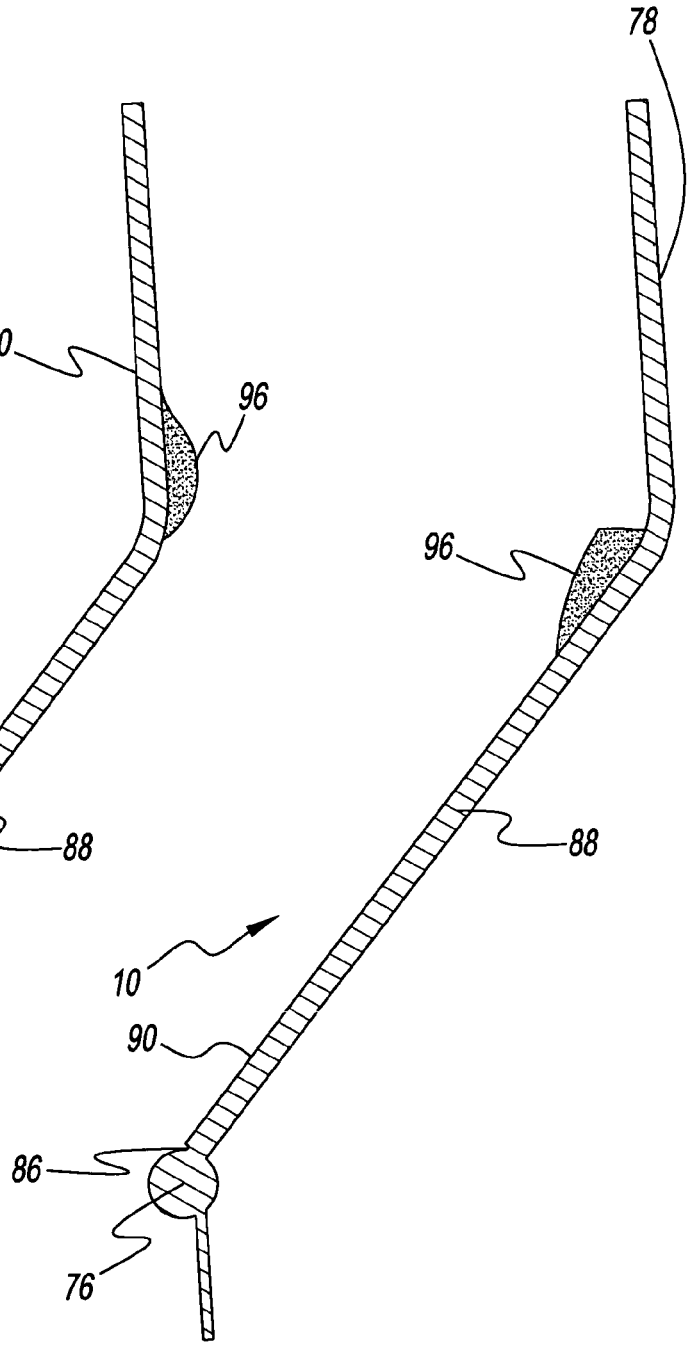
FIG. 13 is another top cross sectional view of an eleventh embodiment of a cuffed portion of the glove.

FIG. 13 shows an eleventh embodiment of the cuffed portion of the glove 10. The glove 10 preferably has the third protrusion 96 that is on the exterior surface 90 of the first tubular section 78. The third protrusion 96 preferably has a generally triangular shape. The triangular shaped third protrusion 96 is raised. The triangular shaped third protrusion 96 also provides the wearer with a fold indicator as to a location where to invert the glove 10 and may be disposed in any suitable location on or in the glove 10.

Figure 14:
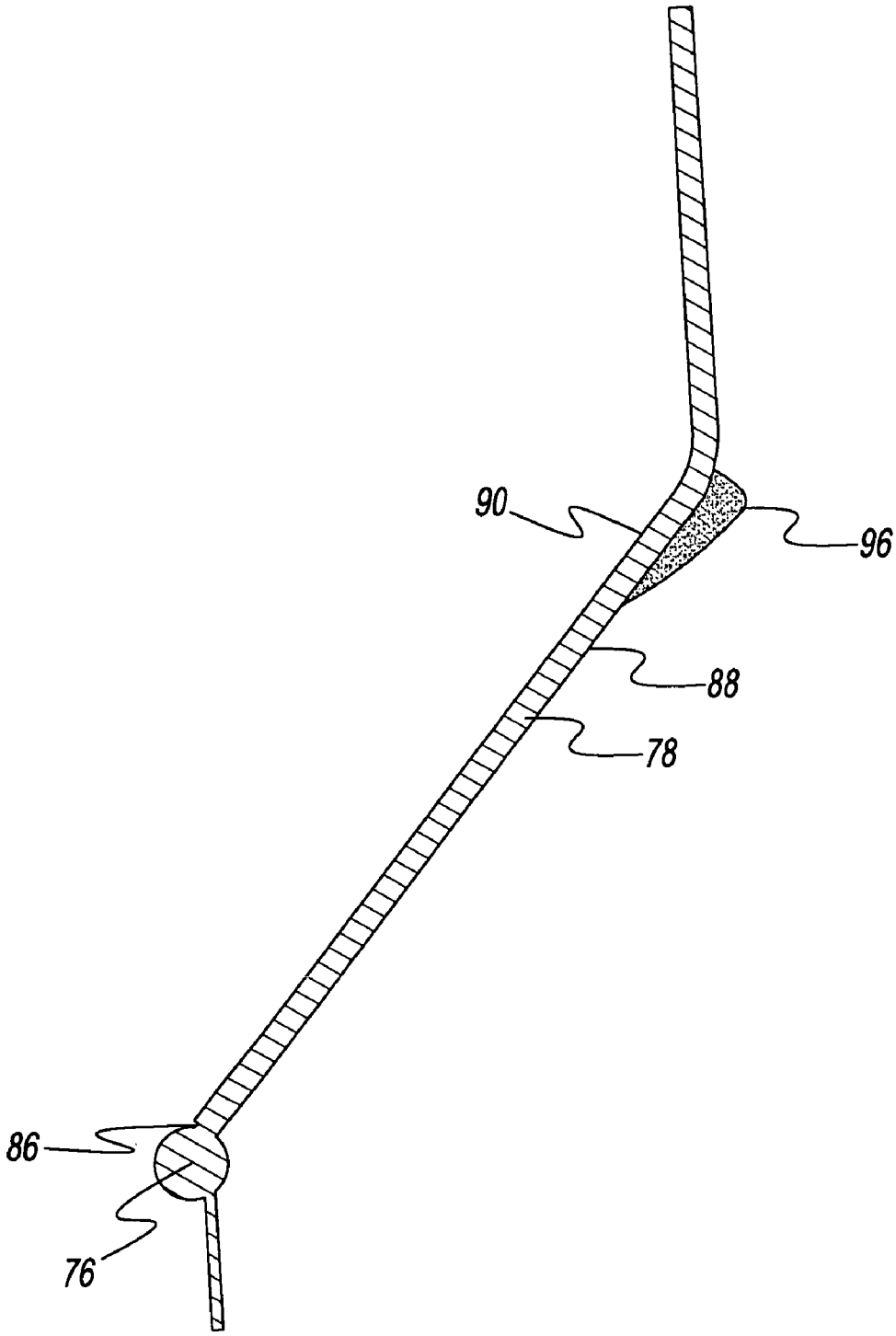
FIG. 14 is another view of a twelfth embodiment of a cuffed portion of the glove with the view being cut through a longitudinal axis of the glove.

FIG. 14 shows a twelfth embodiment of the cuffed portion of the glove 10. The glove 10 preferably has the third protrusion 96 on a different location than FIG. 13. The third protrusion 96 is on the interior surface 88 of the first tubular section 78 and preferably has a generally triangular shape. The triangular shaped third protrusion 96 preferably contacts the wearer and is raised by the wearer's skin. The raised third protrusion 96 in turn raises the exterior surface 90 of the glove 10 a predetermined amount. This predetermined raised amount of the exterior surface 90 and may be in any location on the glove 10. The triangular shaped third protrusion 96 again also provides the wearer with a noticeable fold indicator as to a location where to invert the glove 10 for forming the cuff portion 54.

Figure 15:
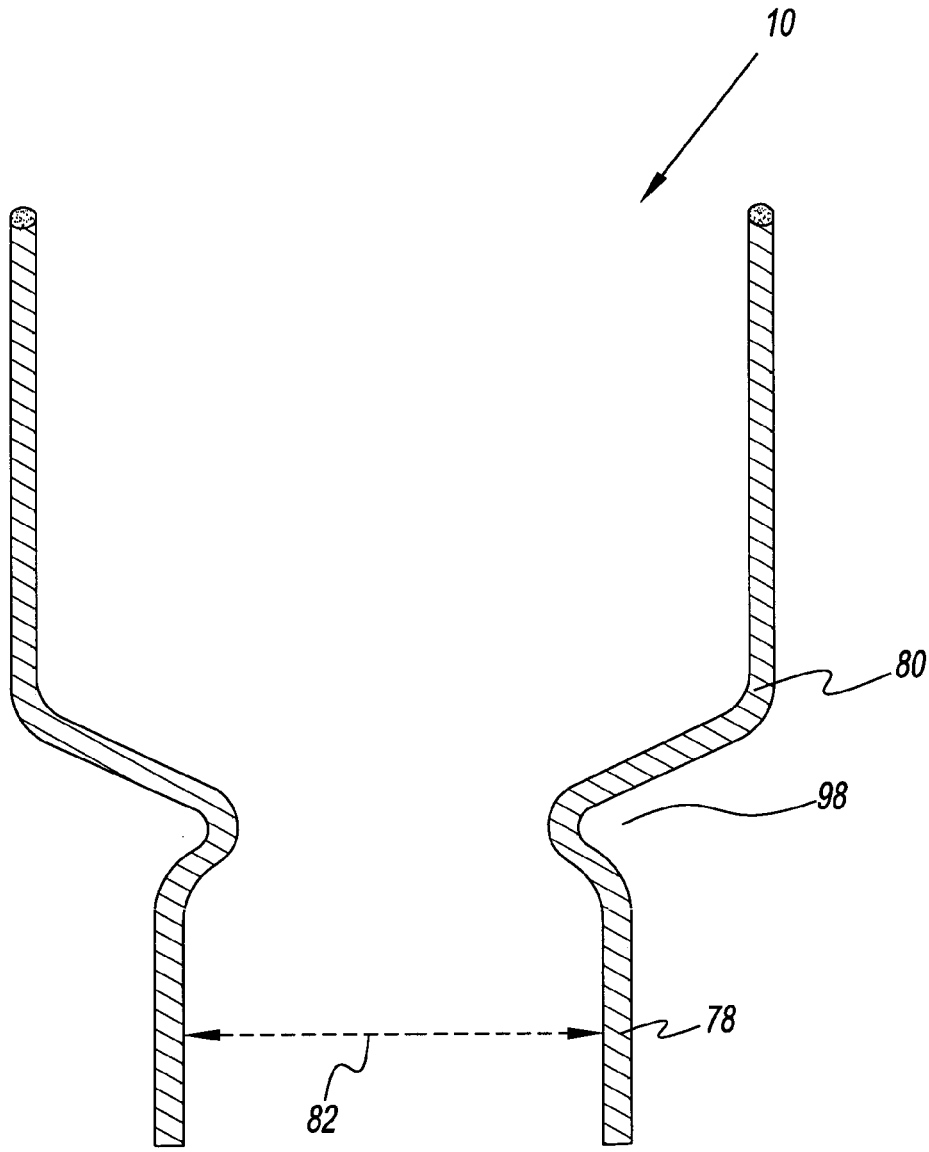
FIG. 15 is a view of a thirteenth embodiment of a cuffed portion of the glove with the view being cut through a longitudinal axis of the glove.
Figure 15A:
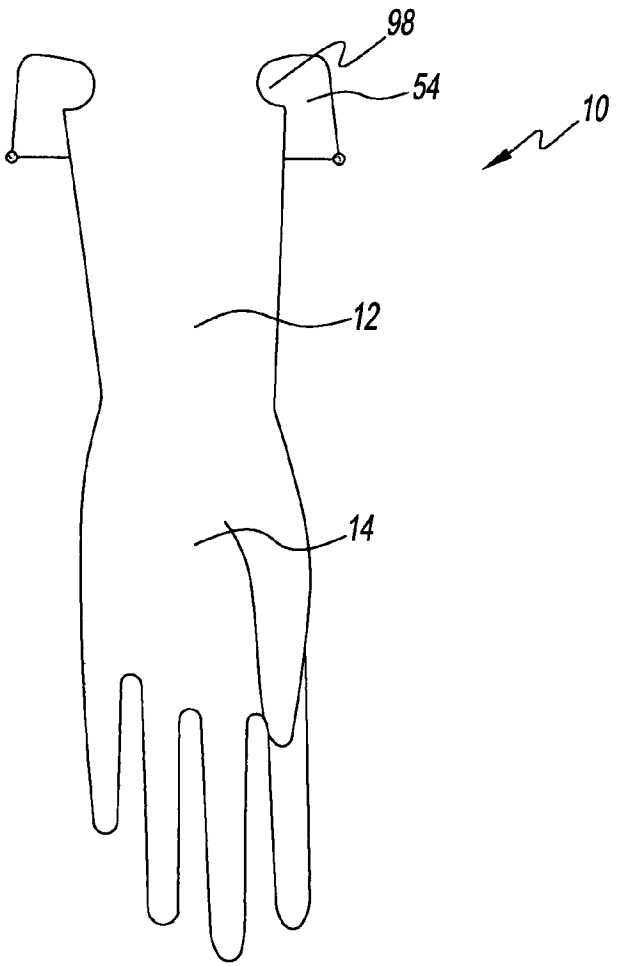
FIG. 15A is a perspective view of the glove with the cuffed portion of FIG. 15.

FIG. 15 shows a thirteenth embodiment of the cuffed portion of the glove 10. The glove 10 preferably has a substantially notch shaped indentation 98. The notch shaped indentation 98 is on a first lateral side or neck at an intersection of the first tubular section 78 with the second tubular section 80. The notch shaped indentation 98 preferably grips the wearer's arm and reduces the first diameter 82. The reduced first diameter 82 may be varied and any size in the art and improves the fitting of the glove 10. Alternatively, the notch shaped indentation 98 has a width so that the wearer may fold and form the cuff portion at a location being substantially adjacent to the second tubular section 80. Referring to FIG. 15A, there is shown a bottom perspective view of the substantially notch shaped indentation 98 of the glove 10 forming the cuff portion 54. The wearer using the glove 10 uses the substantially notch shaped indentation 98 as the fold indicator where to form the cuff portion 54 on the arm covering portion 12. Also, the substantially notch shaped indentation 98 further grips the wearer's arm for better fit. One skilled in the art should appreciate that the substantially notch shaped indentation 98 may be disposed in any suitable location of the arm covering portion 12.

Figure 16:
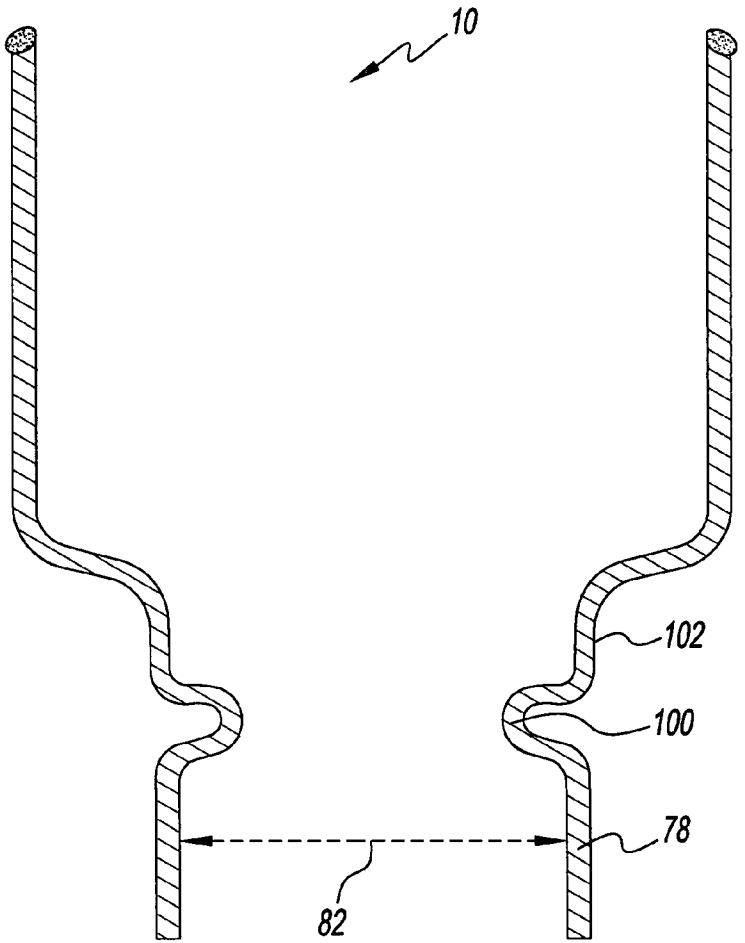
FIG. 16 is a view of a fourteenth embodiment of a cuffed portion of the glove with a cuff gripper with the view being cut through a longitudinal axis of the glove.

FIG. 16 shows the glove 10 preferably having a "U" shaped indentation 100 on a first lateral side 102 of the first tubular section 78 extending around the periphery thereof. The "U" shaped indentation 100 preferably grips the wearer's arm and reduces the first diameter 82 on the lateral sides thereof for the improved and taught fitting of the glove 10.

Figure 16A:
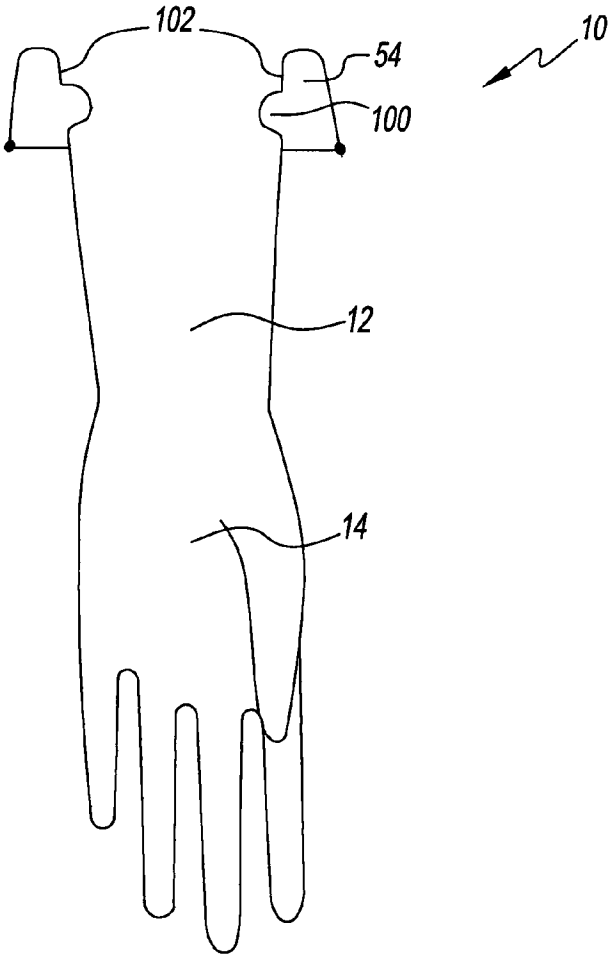
FIG. 16A is a perspective view of the glove with the cuffed portion of FIG. 16.

Referring to FIG. 16A, the "U" shaped indentation 100 on the first lateral side 102 of the glove 10 forming the cuff portion 54. The "U" shaped indentation 100 is at a location closer to the hand covering portion 14 of the glove 10 than the embodiment shown on FIG. 15A. The wearer using the glove 10 uses the "U" shaped indentation 100 on the first lateral side 102 as the fold indicator where to form the cuff portion 54 on the arm covering portion 12 of the glove 10. Also, the "U" shaped indentation 100 on the first lateral side 102 grips the wearer's arm for better, tighter, and a more comfortable fit. Again, one skilled in the art should appreciate that the "U" shaped indentation 100 may have any width and be disposed on the first lateral side 102 in any suitable location of the arm covering portion 12.

Figure 17:
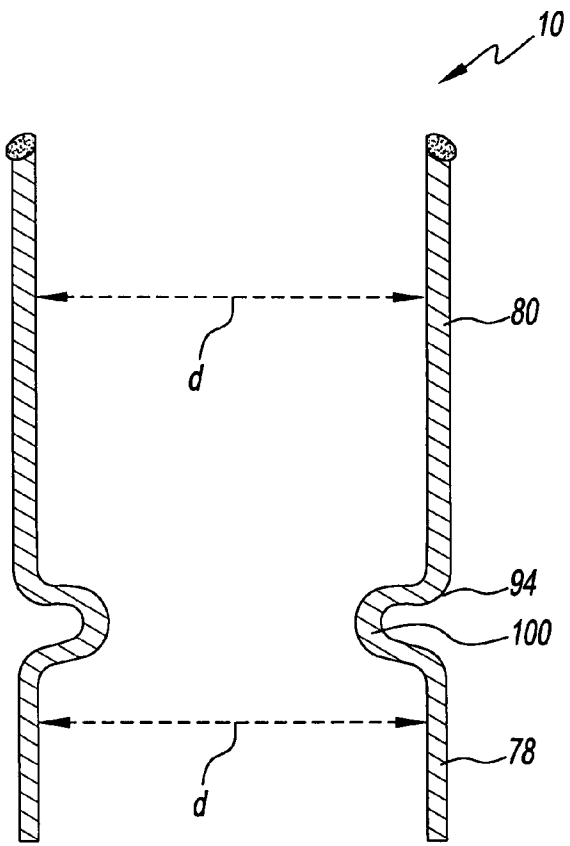
FIG. 17 is a view of a fifteenth embodiment of a cuffed portion of the glove with the view being cut through a longitudinal axis of the glove.

FIG. 17 shows a fifteenth embodiment of the cuffed portion of the glove 10. The glove 10, in this embodiment, preferably has the substantially "U" shaped indentation 100 on the first lateral side 94 of the first tubular section 78. The substantially "U" shaped indentation 100 extends around the periphery thereof. In this embodiment, the second tubular section 80 has the same diameter d as the first tubular section 78 and this diameter may be varied and be any suitable diameter known in the art. In this preferred embodiment, the substantially "U" shaped indentation 100 preferably grips the wearer's arm on the lateral sides thereof for the improved fitting of the glove 10.

Figure 18:
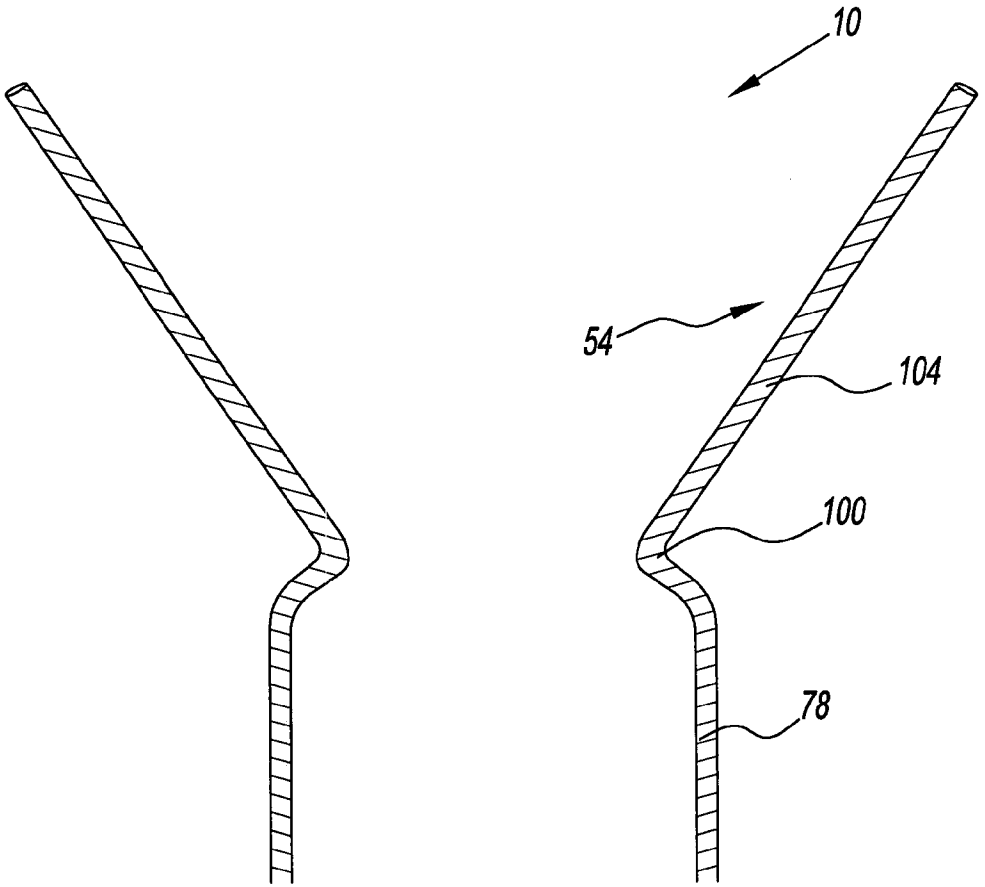
FIG. 18 is a view of a sixteenth embodiment of a cuffed portion of the glove with the view being cut through a longitudinal axis of the glove.

FIG. 18 shows a sixteenth embodiment of the cuffed portion of the glove 10. The glove 10, in this embodiment, preferably has the substantially "U" shaped indentation 100 on the first lateral side 102 of the first tubular section 78 extending around the periphery thereof. In this embodiment, the first tubular section 78 is connected to a substantially conical shaped member 104, and the substantially "U" shaped indentation 100 preferably grips the wearer's arm on the lateral sides thereof for improved fitting of the glove 10 while the conical shaped member 104 forms the cuff portion 54. Thus, the conical shaped member 104 diverts liquid away from contacting the wearer.

Figure 19:
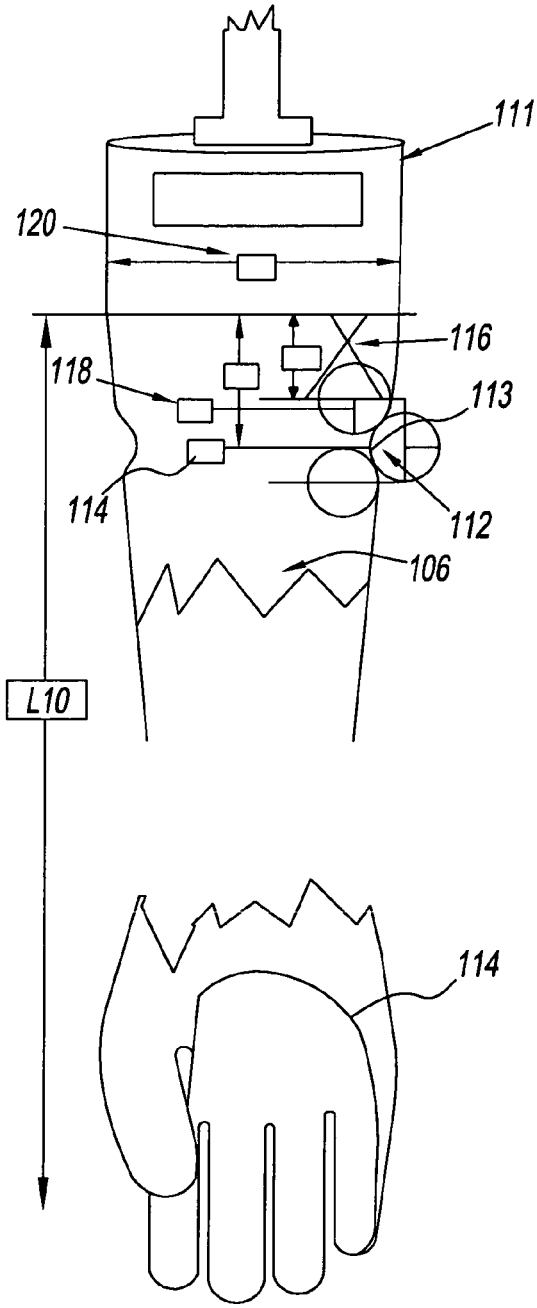
FIG. 19 is a top view of a glove forming device connected to a hook for dipping the device into a glove making material and manufacturing the glove.
Figure 20:
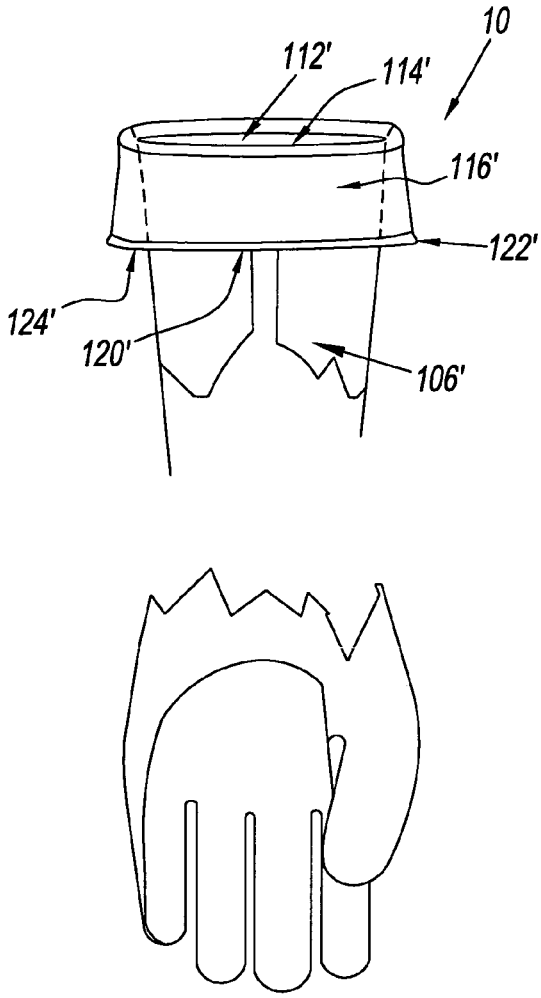
FIG. 20 is a top view of the resulting glove made by the glove forming device of FIG. 19 with the glove being in a cuffed or folded position.

FIG. 19 shows an embodiment of a forming device 111' for forming the glove 10 of the present invention such as the glove 10 shown in FIG. 20. The forming device 111 preferably is dipped in a glove making material such as latex, rubber, neoprene, or polyvinyl chloride, or any other liquid glove making material known in the art. The glove making material in a liquid state surrounds the forming device 111 for forming the glove 10. One skilled in the art should appreciate that the glove 10 made by the forming device 111 will have a substantially complementary dimension and shape relative to the forming device. In FIG. 19, the forming device 111 is shown with a disconnected hand covering portion to indicate that a glove 10 may be formed with any preferred length l10. The forming device 111 is hung from a suitable structure during manufacturing by a hook device. Preferably, forearm segment 106 is integrally formed with the device for forming the hand covering portion 114 of the glove 10, as shown in FIG. 19. Alternatively, the forming device 111 may have a forearm segment 106 with a first opening for connection to a device for forming the hand of the glove 10. The first opening is generally circular in shape. The diameter of the first opening may be about 2.6 inches. The forearm segment 106 of the complementary glove 10 made by the forming device 111 may be connected to the hand covering portion 114.

The forearm segment 106 may have any preferred length, preferably, a length l10 of about 7 inches. The forearm segment 106 is connected to a first pivot line 112. The forearm segment 106 preferably has a radius of curvature of about 0.5 inches at an end 113 adjacent to the first pivot line 112. The first pivot line 112 may be formed, as mentioned previously, by a gauge change in the material forming the glove 10. Preferably, the pivot line 112 is a bow hinge point with an inward radius of curvature of about 0.5 inches curving inwardly towards an interior of glove 10. The forming device 111 forms an even glove film thickness at the bow hinge. The first pivot line 112 has a pivot line diameter 114. The pivot line diameter 114, preferably, is about 3 inches to about 3.2 inches, and more preferably about 3.2 inches. The first pivot line 112 may have a height of about 0.3 inches.

The first pivot line 112 is connected to a second segment 116. The second segment 116 preferably has a radius of curvature of about 0.5 inches at an end adjacent to the first pivot line 112. The second segment 116 is preferably generally cylindrical and has a second diameter 118. The second diameter 118 is about preferably about 3.3 inches to about 3.6 inches, and more preferably about 3.6 inches, and is connected with the first pivot line 112. The second segment 116 has a length of about 2 inches. The second segment 116, at an opposite second end relative to the first pivot line 112, has a different diameter than the second diameter 118. At the opposite, second end of the second segment 116, the second segment has a cuff diameter 120 that is greater than the diameter 118. The cuff diameter 120 preferably is about 3.8 inches to about 4 inches, and more preferably about 4 inches. Preferably, the second diameter 118 has a distance of about 1.3 inches to the cuff diameter 120. Preferably, the former device is dipped up above line 121.

Referring to FIG. 20, there is shown the glove 10 made by the forming device 111 of FIG. 19. For the sake of illustration, the corresponding portions of the glove 10 made by the forming device 111 are shown with the same reference numerals. The second segment 116' of the glove 10, as shown, is folded over the forearm segment 106' of the glove. The second segment 116' folds at the first pivot line 112' to form a cuffed portion 122'. Preferably, the second segment 116' is inverted on a stress point of the bow hinge at the pivot line 112'. As shown, the cuffed portion 122' may have the cuff diameter 120' of about 3.8 inches to about 4 inches, and more preferably about 4 inches, that is greater than the pivot line diameter 114'. As discussed herein, the cuffed portion 122' forms a space 124' for trapping liquid therein.

Figure 21:
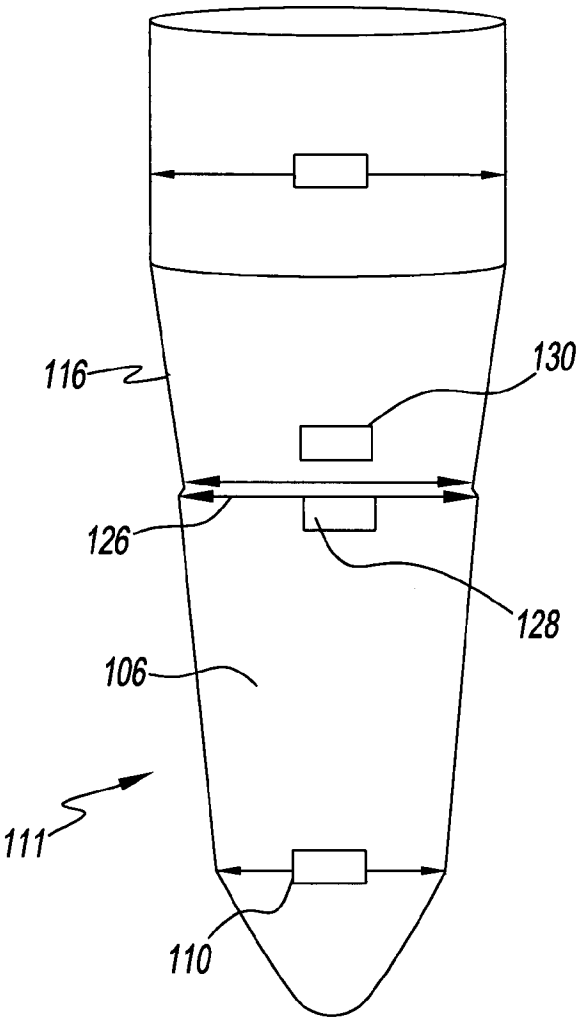
FIG. 21 is a side view of a glove forming device connected to the hook for manufacturing the glove.

Referring to FIG. 21 that shows another embodiment of a forming device 111, the device or former is dipped in the glove making material for forming the glove 10 having complementary dimensions and a complementary shape as the forming device. The forming device 111 has the forearm portion 106 with a second end 126. The second end 126 is opposite the hand covering portion (not shown). The second end 126 has a diameter 128 of about 3.3 inches. The forearm portion 106 is connected at the second end 126 to the second segment 116. In this embodiment at the second end 126, the second segment 116 has a diameter that is smaller than the diameter 128 of the forearm portion 106.

Figure 22:
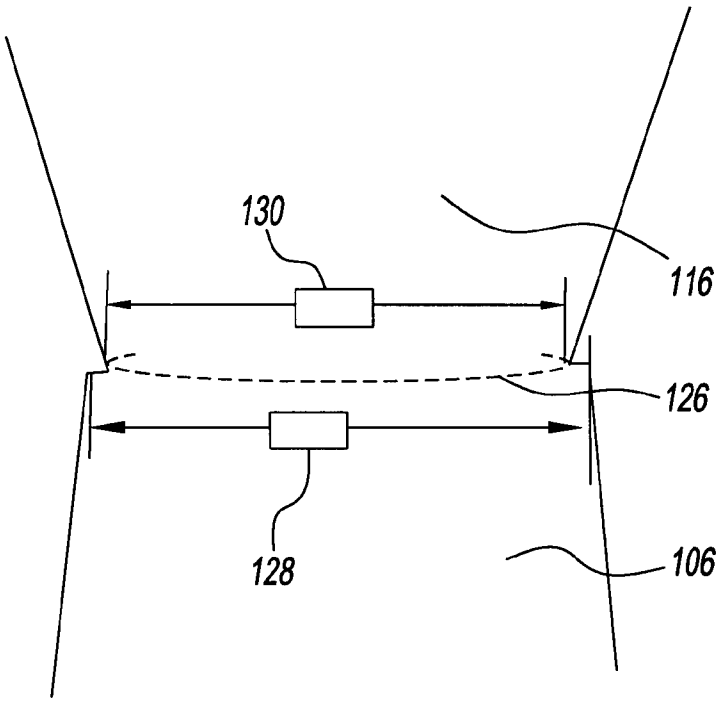
FIG. 22 is an enlarged side view of the glove forming device of FIG. 21 for manufacturing the cuffed portion of the glove.
Figure 24:
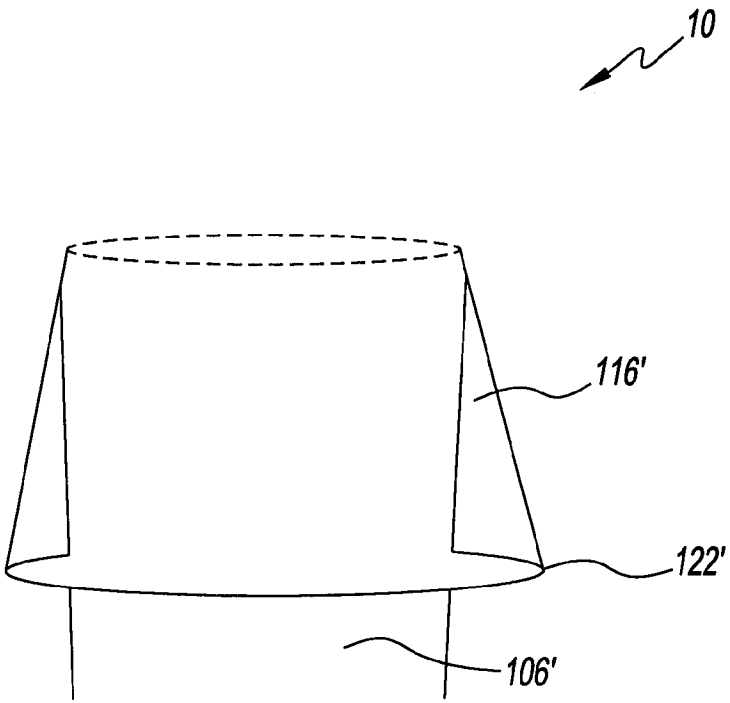
FIG. 24 is a side view of the resulting glove made by the glove forming device of FIG. 23 with the glove being in a folded position.
Figure 23:
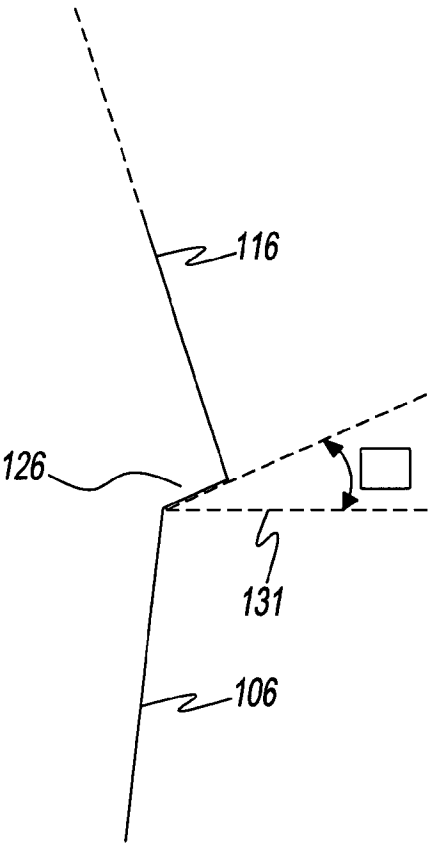
FIG. 23 is another enlarged lateral side view of the glove forming device of FIG. 22.

Referring to the FIG. 22 embodiment, the second segment 116 has a diameter 130 of about 3.1 inches to form a notch like member in each side of the forming device 111 and thus the glove 10 that is formed thereon. The notch like member surrounds an outer periphery thereof. Referring to FIG. 23, there is shown a close up view of a lateral edge of the second segment 116 connected to the forearm segment 106. In this embodiment, at the lateral edge of the forming device 111 (and thus the corresponding glove 10) the forearm segment 106 forms an angle with a horizontal plane 131 at the connection to the second segment 116. The angle is in a range that includes twenty degrees. The diameter 128 of the forearm segment 106 and the diameter 130 of the second segment 116 forms an indicative fold region on the corresponding glove 10 made by the forming device 111 at the second end 126 that is about 0.125 inches in height. This region provides a wearer a location as to where to fold the glove 10 to form the cuffed portion 122' as shown in FIG. 24.

Figure 25:
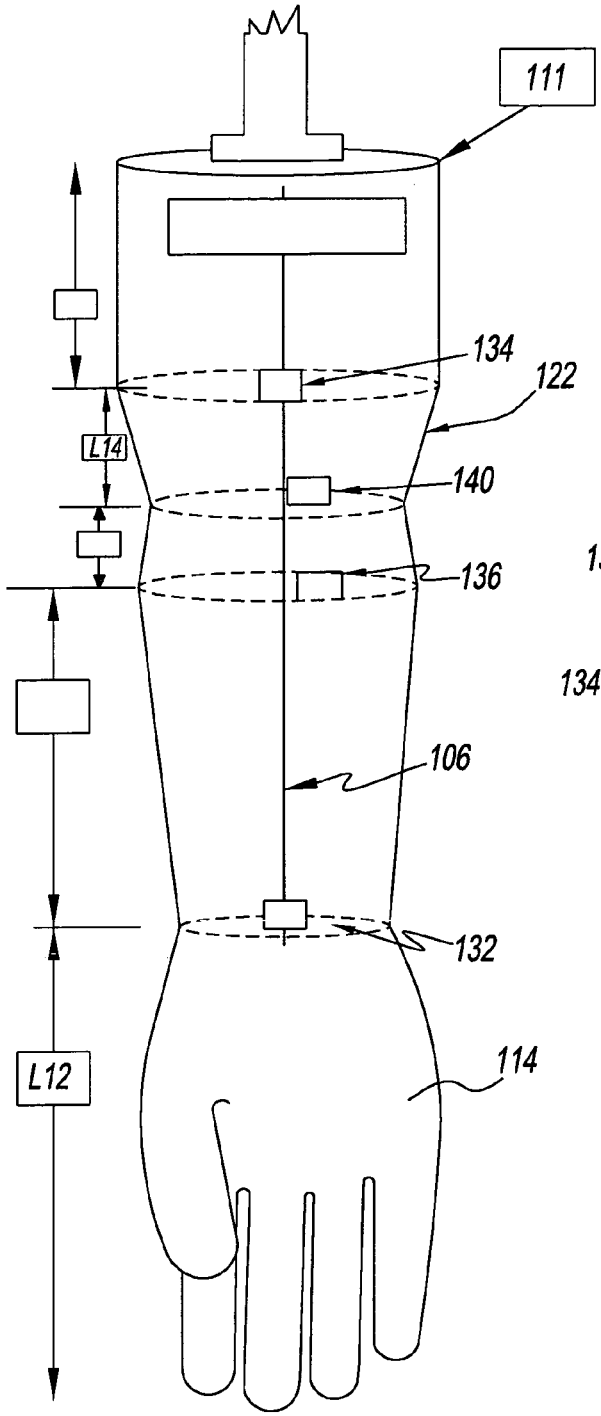
FIG. 25 is a top view of a glove forming device connected to a hook for manufacturing a glove.
Figure 26:
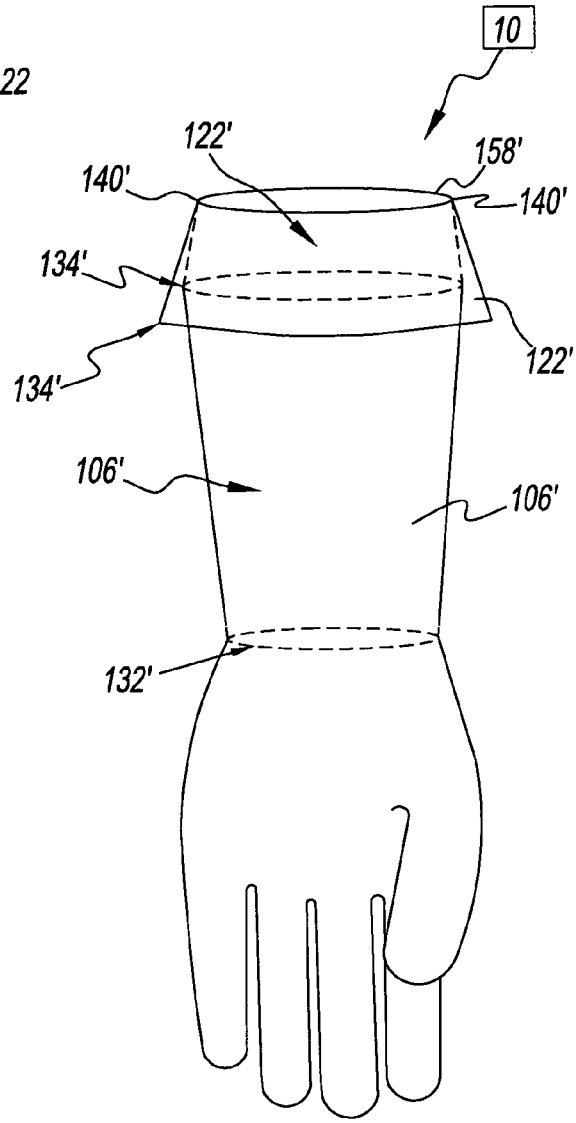
FIG. 26 is a top view of a glove manufactured with the glove forming device of FIG. 25, with the glove being in a folded or cuffed position.

Referring to FIG. 25, the forearm segment 106 of the forming device 111 is formed with a shape that has a number of different diameters, or a first diameter 132, a third diameter 136, and a fourth diameter 138. Alternatively, the forming device may have a second diameter on the forearm segment between the first diameter 132 and the third diameter 136 that is smaller than the third diameter 136. The number of differently sized diameters allow the cuff portion 122' of the corresponding glove 10 to fit in a narrow furrow of the glove and thus remain in position once the cuff portion 122' folds in a cuffed position, as shown in FIG. 26. The number of differently sized diameters of the forearm segment 106 also form a noticeable fold line 140'. The fold line 140' assists the wearer with a tactile feedback as to where to fold the glove 10 to form the cuffed portion 122' as shown in FIG. 26.

Referring again to FIG. 25, the first diameter 132 of the forearm segment 106 is adjacent to the hand covering portion 114. The glove 10 formed by the forming device 111 with the complementary shape and size also has the forearm segment 106. The forearm segment 106 connects to the hand covering portion 114. The hand covering portion 114 preferably has a length l12 of about 7 inches. Alternatively, a separate forming device may form the hand covering portion 114. The first diameter 132 of the forearm segment is preferably about 2.6 inches. The forearm segment 106 then slightly enlarges at the third diameter 136 to preferably about 3.3 inches. Thereafter, the forearm segment 106 tapers to the fourth diameter 138, that is smaller than the third diameter 136, to about 3 inches. This noticeable reduction forms the noticeable fold line 140 that provides a tactile feedback to the wearer of a fold location. The first diameter 132 has a distance of about 5 inches to the third diameter 136. The third diameter 136 has a distance of about 1 inch to the fourth diameter 140.

Figure 27:
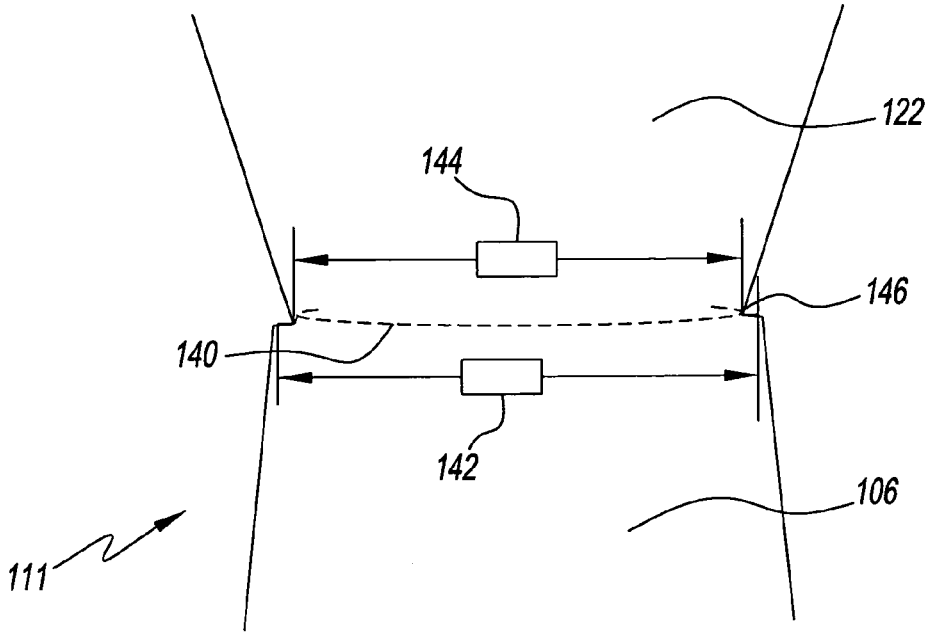
FIG. 27 is an enlarged, side view of the glove forming device for manufacturing the cuffed portion of glove of FIG. 26.
Figure 28:
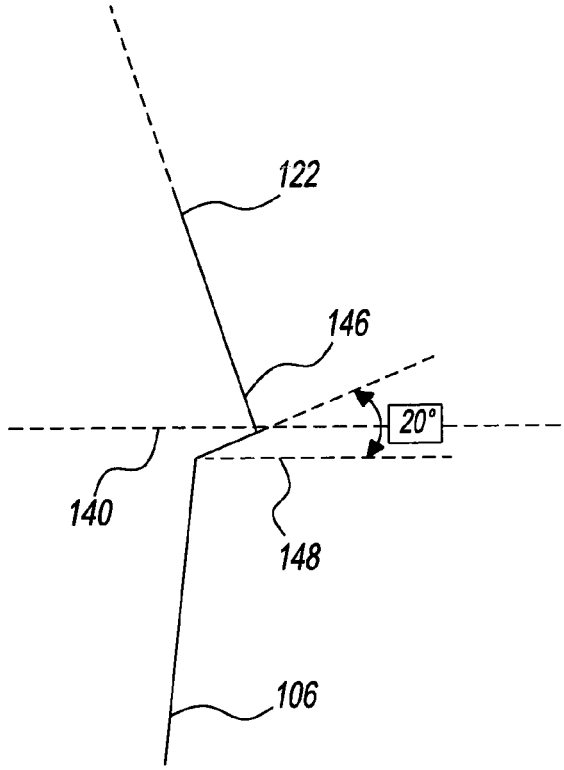
FIG. 28 is another enlarged view of a lateral side of the glove forming device for manufacturing the cuffed portion of the glove of FIG. 26.
Figure 29:
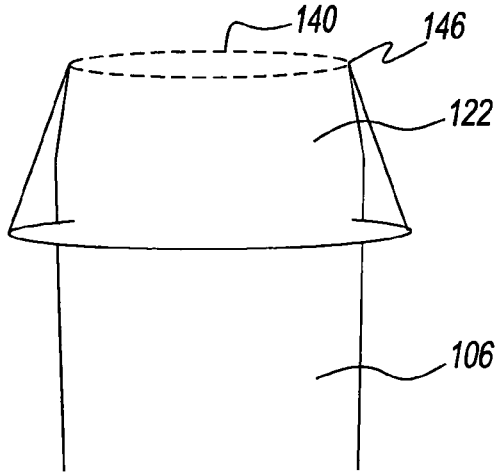
FIG. 29 is side view of the cuffed portion of the resulting manufactured glove made by the glove forming device of FIG. 28 with the glove in the folded position.

Connected to the forearm segment 106 is the cuff portion 122 that is preferably about 1.5 inches in length 114 and conical shaped with a fifth diameter 141 that has a 3.8 inch diameter. The fifth diameter 141 is preferably about 3 inches from a top edge 143 of the former 111. The former 111 preferably is dipped up to a height between the fifth diameter 141 and the top edge 143 of the former 111. Referring to FIG. 26, once the wearer finds the fold line 140', and inverts the cuff portion 122', the cuff portion folds over the forearm segment 106' at the fold line having the fourth diameter 138'. Fold line 140' acts as a hinge to invert the cuff portion 122' on a stress point of an angle of the hinge. Referring to FIG. 27, the cuffed portion 122 preferably connects to the forearm segment 106 at the fold line 140 as shown. In this embodiment, the forearm segment 106 has a forearm diameter 142 of about 3 inches and a cuffed portion diameter 144 of about 2.9 inches. Preferably, given that there is a difference in the forearm diameter 142 relative to the cuffed portion diameter 144, a portion of the forearm portion 106 juts out an amount to form a noticeable shoulder tension band 146 thereon. Referring to FIG. 28, the shoulder tension band 146 forms an angle with a horizontal plane 148 that is through the fold line 140, in a range that includes twenty degrees. The shoulder tension band 146 has a height of about 0.125 inches to provide the wearer with tactile feedback as to where to fold the glove 10 such as shown in FIG. 29.

Figure 30:
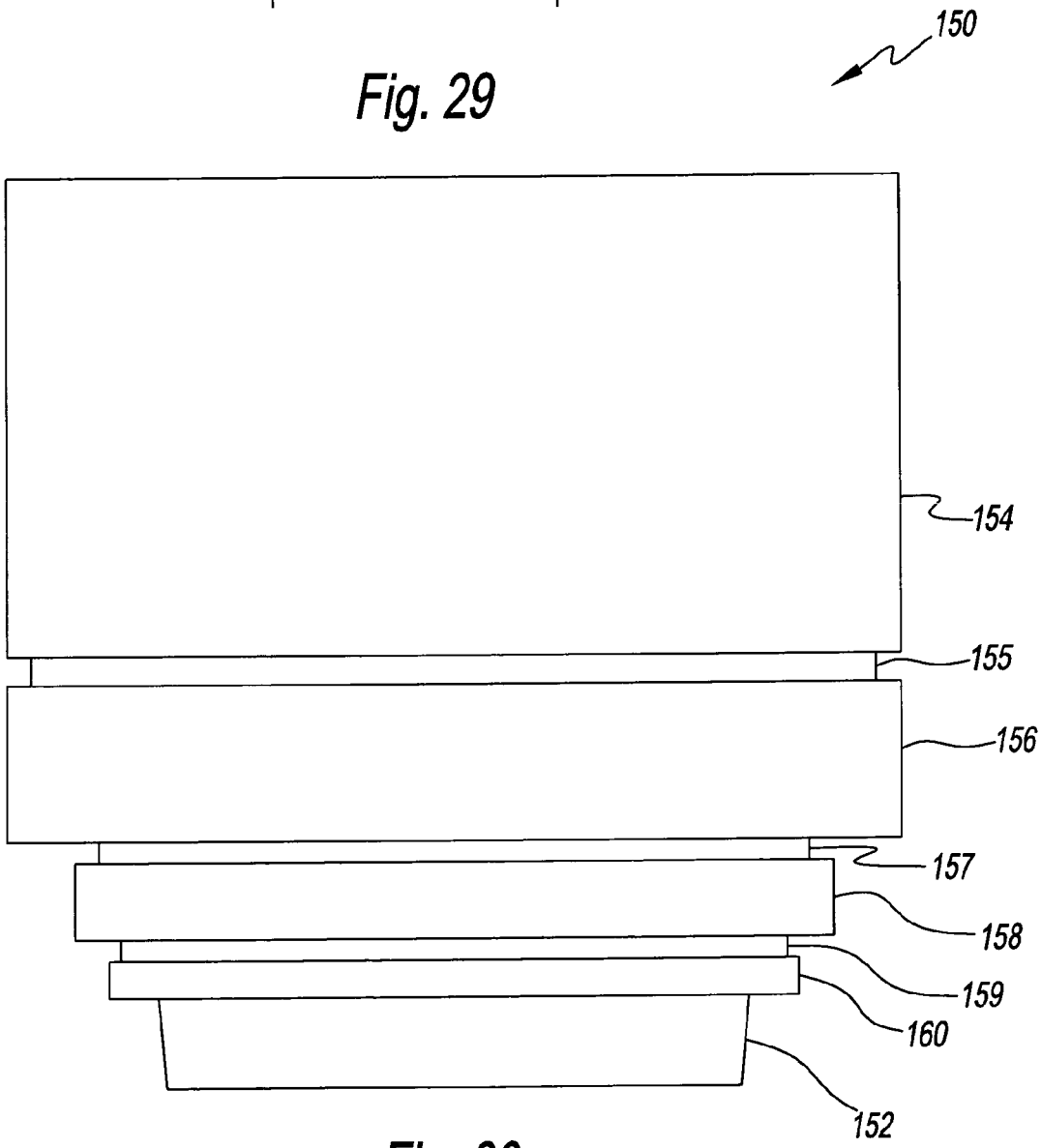
FIG. 30 is a front enlarged view of a plug forming device for manufacturing a cuffed portion of the glove of the present invention.

Referring to FIG. 30, there is shown a plug forming device 150 that connects to the forming device for dipping into a glove making material. The plug forming device 150 is shown detached from an arm and hand covering forming device for simplicity. However, one skilled in the art should appreciate that the plug forming device 150 is integrally formed with the arm and hand covering forming device for forming the glove. The plug forming device 150 preferably forms a cuff portion having a complementary size and shape is preferably a resilient member, such as a wood, aluminum, steel, metal, plastic or any other resilient polymer or resilient material, or alternatively may be any resilient member that can withstand the glove formation process. The cuff portion (made from dipping the plug forming device 150 into the liquid glove making material) and is deformable, folded and inverted to form an inverted cuff. The plug forming device 150 is preferably formed with a number of segments connected to a core 152. The core 152 is preferably a complementary size to a diameter of the arm covering portion of the glove. The plug forming device 150 forms the cuff portion. The cuff portion is intended to connect to the glove for forming a portion on the glove that can be inverted for forming a barrier for collecting liquid therein.

Preferably, and as in the embodiment shown, the plug forming device 150 is solid and has a first segment 154, a second segment 156, a third segment 158, and a fourth segment 160, with each of the first through fourth segments 154, 156, 158, and 160 surrounding the core 152. The first segment 154 has a height of about 3 inches and a diameter of about 5 inches, and is offset from the second segment by a first channel 155. The first channel 155 is about 4.8 inches in diameter. The second segment 156 has a height of about 0.75 inches and a diameter of about 5 inches. The second segment 156 is offset from the third segment 158 by a second channel 157 that is about 3.4 inches in height. The third segment 158 has a diameter of 4 inches and a height of about 0.3 inches. The third segment 158 is offset from the fourth segment 160 by a third channel 159 that has a diameter of about 3.4 inches. The fourth segment 160 has a height of about 0.25 inches with a diameter of about 3.6 inches. The core 152 has a complementary diameter to mate with the glove forming device or is integrally connected thereto. The core 152 has a diameter that is less than 3.6 inches for securing to a suitable glove forming device 111, but may have other sizes.

Figure 31:
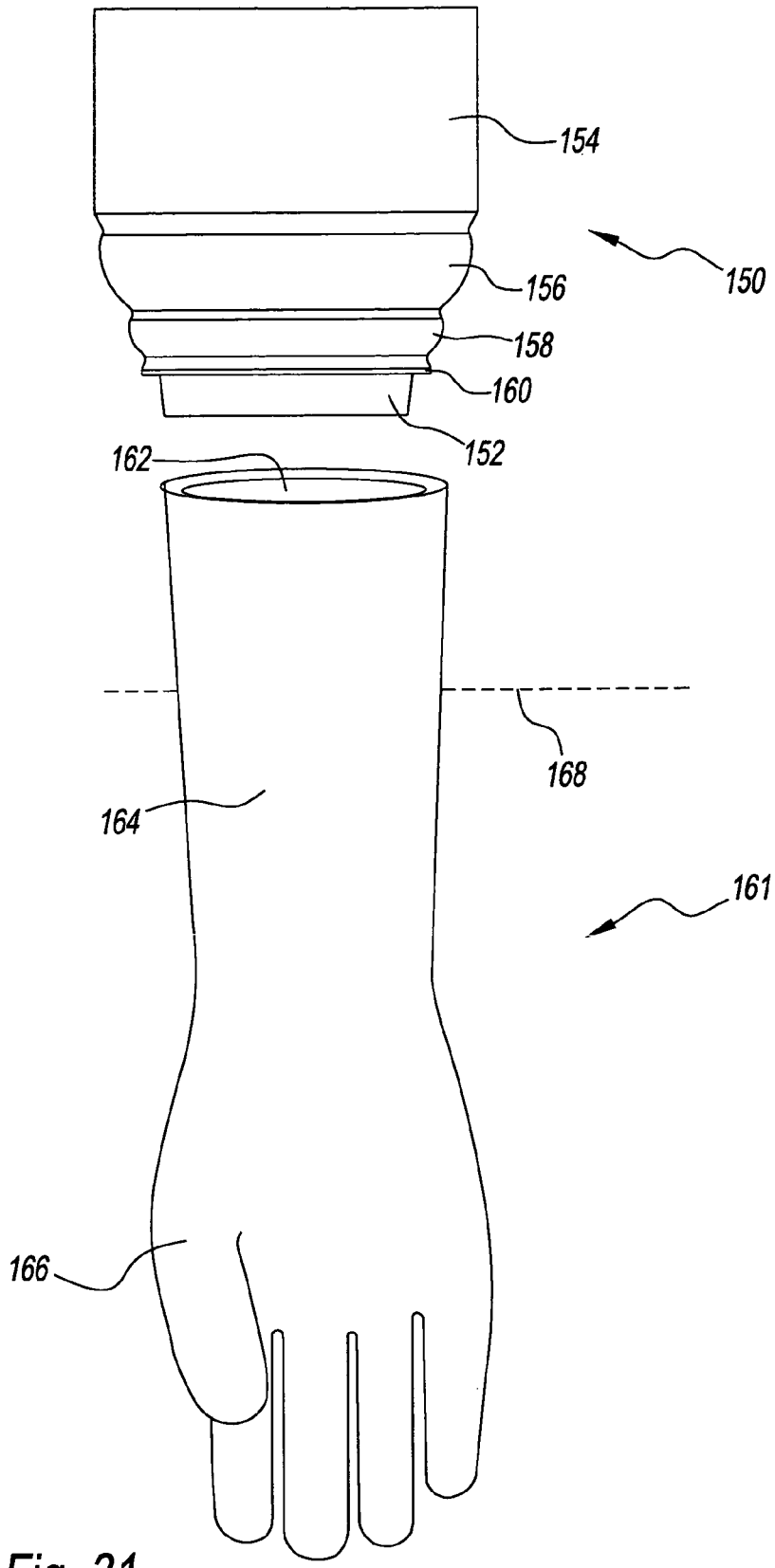
FIG. 31 is a front enlarged view of the plug forming device of FIG. 30 being separated from the glove forming device.
Figure 32:
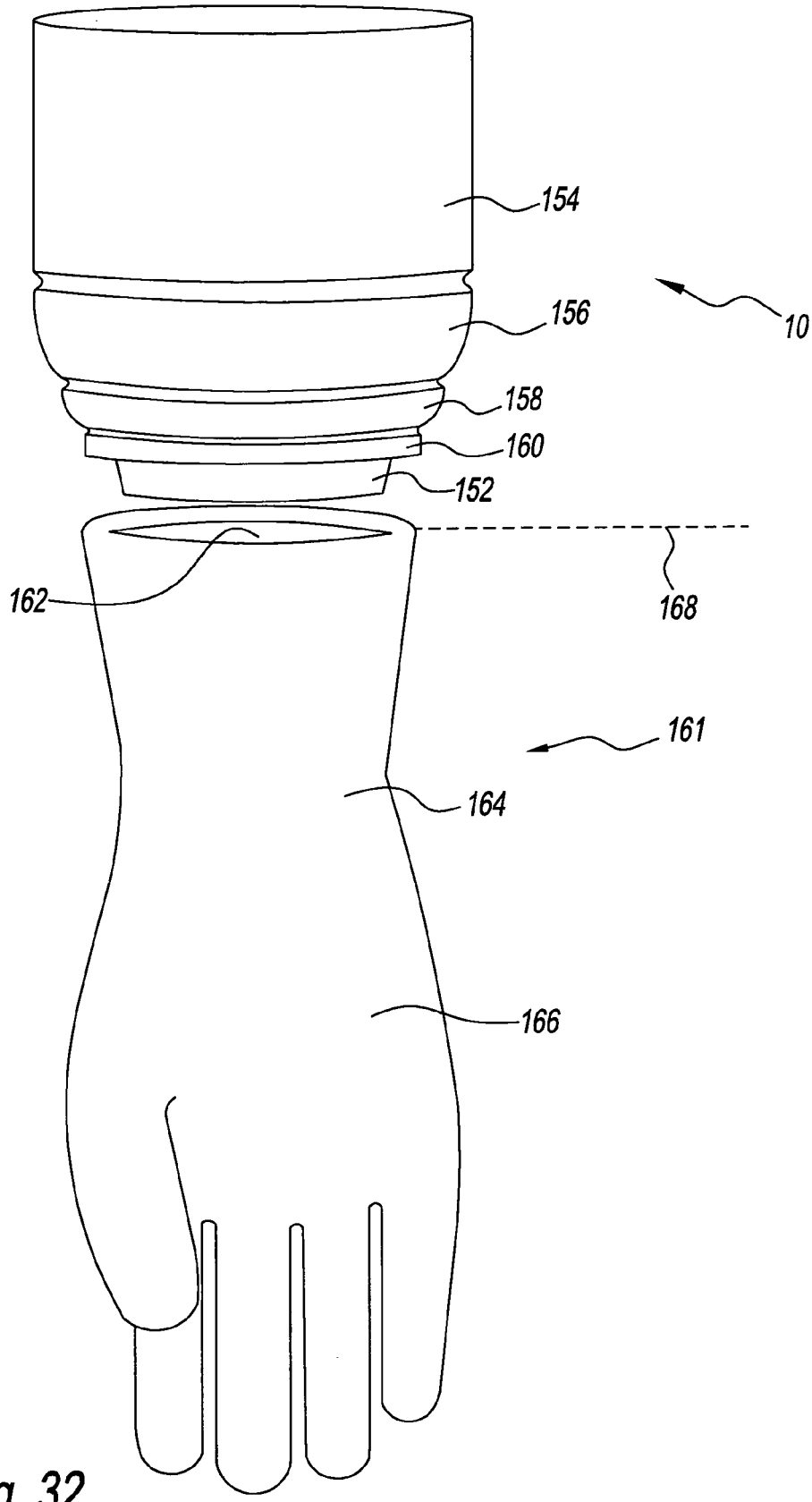
FIG. 32 is another front view of the plug forming device of FIG. 30 being separated from the glove forming device.

Referring to FIG. 31, the plug forming device 150 is shown detached from a glove forming device 161 for simplicity. The glove forming device 161 has an opening 162, an arm covering portion 164 and a hand covering portion 166 as is known. The glove 10 has a line of delineation 168 to indicate a point where the fourth segment 160 traverses through the opening 162 to connect to the glove forming device 161. The fourth segment 160 of the plug forming device 150, as shown in FIG. 32, mates therewith and is connected by molding, adhesive, mechanical fasteners or any combination thereof, or any other connection means known in the art.

One skilled in the art should appreciate that the location or line of delineation 168 where the fourth segment 160 of the plug forming device 150 connects to the glove forming device 161 may change depending on one or more design considerations such as size of the glove, and thickness of the glove. One skilled in the art should further appreciate that the other segments of the first through fourth segments 154, 156, 158, and 160 of the plug forming device 150 may be connected to glove forming device 161 depending on one or more design considerations such as size of the glove, and thickness of the glove.

The plug forming device 150 is then connected to the glove forming device 161 and becomes an integral member therewith and is dipped in the glove making material to form the glove 10 with the complementary size and shape. The formed glove 10 has the cuff portion 54 with the complementary dimension to the plug forming device 150. The cuff portion 54 having these dimensions is inverted and shields the wearer from being contacted with the liquid in operation. In another embodiment of the present invention, the cuff portion 54 may be formed as a deformable material such as a rubber, latex, a polymer or plastic, then connected to an existing glove. Alternatively, the cuff portion 54 and the glove 10 may be formed by two separate operations at different times. The deformable material may then be connected to the glove 10 and be folded over the arm covering portion 12 to form an inverted cuffed member however, most preferably, the glove 10 and the cuff portion are made in one operation at the same time.

Referring to FIGS. 33A through 33D, there is shown another embodiment of the glove forming device generally represented by reference numeral 170. As can be understood from one skilled in the art, the glove forming device 170 is dipped into a liquid material for forming the glove 10 having complementary dimensions to the glove forming device. In this embodiment, the glove forming device 170 preferably has a notch 172. The notch 172 is preferably adjacent to a forearm portion 175. The notch 172 is disposed therein that extends around an outer surface or circumference of the glove forming device 170.

The notch 172 is preferably substantially "U" shaped as shown and preferably is at about 12.25 inches from a tip of a finger portion 174 of the glove forming device 170.

The finger portion 174 and a hand covering portion 177 is preferably about 7.5 inches in length l22. The glove forming device 170 preferably has a centerline 176 that is down a center of the glove forming device 170. The glove forming device 170 at the notch 172 preferably has a reduced diameter relative to an outer surface 178 of the glove forming device. This reduced diameter (in the complementary notch formed on the glove made by the glove forming device 170) acts as a fold indicator to assist a user with identifying a location where to fold the glove to form a cuffed portion 180 of the glove, as discussed herein.

Figure 33A:
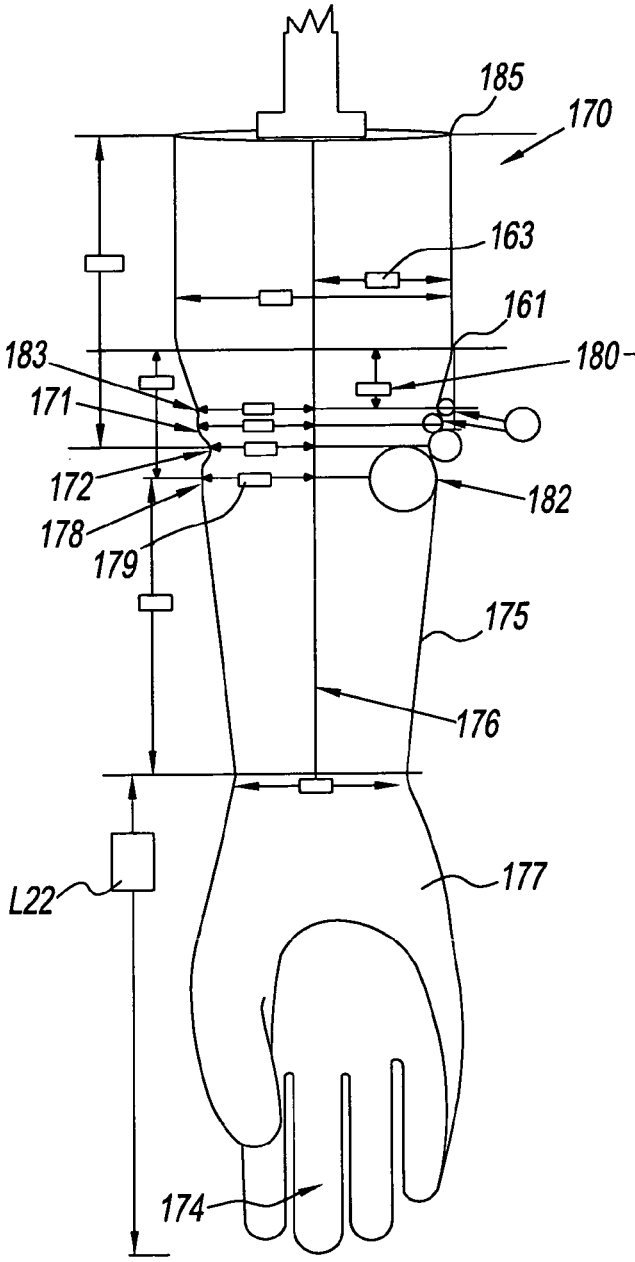
FIG. 33A is a side view of another embodiment of a glove forming device for manufacturing a glove having a cuffed portion according to the present invention.
Figure 33B:
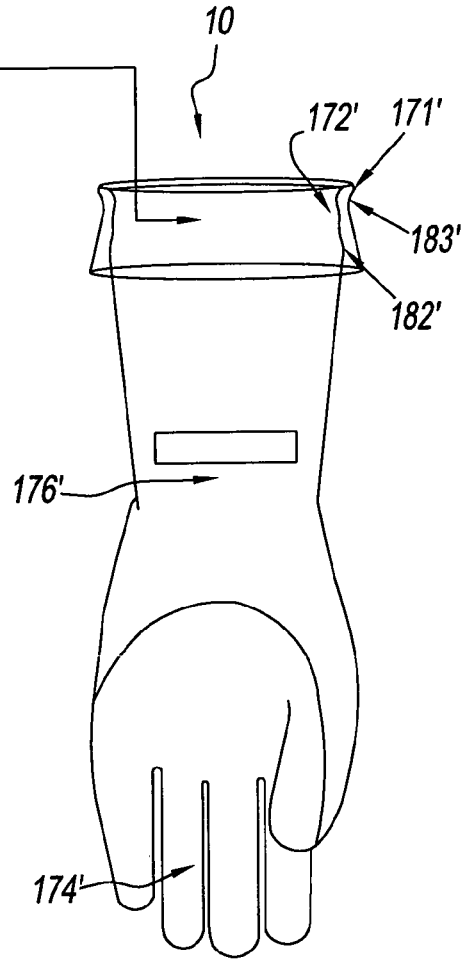
FIG. 33B is a top view of the resulting glove of FIG. 33A in a second position with the cuff portion for trapping liquid.

Referring to FIGS. 33A and 33B, the notch 172 commences at an initial point 182 on the glove forming device 170. At the initial point 182, the plug forming device 170 has a radius 179 of about 1.73 inches and a radius of curvature of about 0.5 inches curving away from the centerline 176. The notch 172 at a narrowest point of the notch has a radius 169 of preferably about 1.6 inches to about 1.625 inches, more preferably about 1.6 inches, from the centerline 176. The notch 172 preferably has a circular, or curved edge that bulges inwardly in a direction toward the centerline 176 to form a substantially circular space with a diameter of about 0.25 inches to about 0.375 inches, and more preferably about 0.25 inches. In a direction away from the notch 172 and away from the finger portion 174, the glove forming device 170 expands to a radius 167 of about 1.8 inches at a bulge 171, then tapers to a radius 165 of about 1.75 inches at a tapered section 183. The tapered section 183 has a radius of curvature of about 0.125 inches curving inwardly toward the centerline 176. Thereafter, the glove forming device 170 then has a radius that gradually expands to about 1 inch in length in a direction opposite the finger portion 174, and the notch 172 to a radius 163 of about 2 inches as measured from the centerline for the remainder of the glove forming device. The forearm portion 175 is a distance of about 2.13 inches from the diameter 161. The notch 172 preferably is 5 inches from a top edge 185 of the plug forming device 170. The plug forming device 170 preferably is dipped up to a point on the centerline 176 within the 5 inches from the top edge 185. In this manner, the glove 10 made therefrom will have the complementary dimensions to the plug forming device 170 and the user will have a prominent visual indicator as to the location where to fold the glove to form the cuffed portion 180. The notch 172, bulge 171, and tapered portion 172 each have a smooth radius of turns to develop a glove film of even thickness. Upon removal of the glove 10 from the plug forming device 170 and reversing or inverting diametric forces are developed in the glove film as opposite to the original fold design. Thus, the glove 10 is cuffed down or folded at the bulge 171', as shown in FIG. 33B, over the initial point 182. The notch 172', bulge 171', and tapered portion 183' form a hinge and hold the cuffed down position because the folds are biased to return to a reversed original molded shape.

Figure 33C:
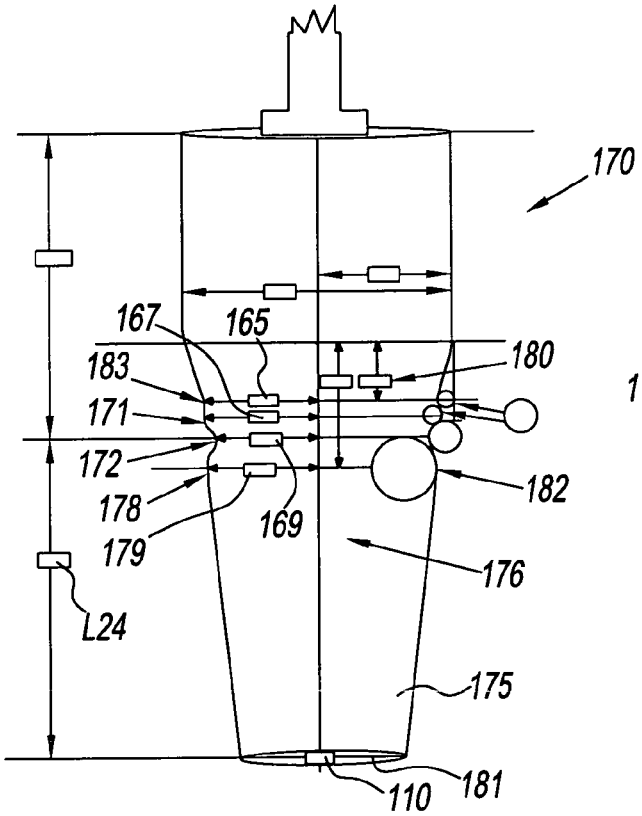
FIG. 33C is a side view of the embodiment of FIG. 33A without the hand covering portion.
Figure 33D:
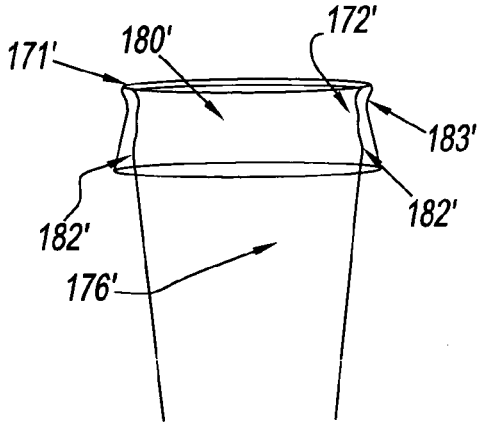
FIG. 33D is a top view of the resulting glove of FIG. 33C in a second position with the cuff portion for trapping liquid.

Referring to FIGS. 33C and 33D, the forming device 170 may have a forearm segment 175 with a first opening 181 for connection to a device for forming the hand 177 of the glove 10. The first opening 181 is generally circular in shape. The first opening 181 also has a diameter 110. The diameter 110 is preferably about 2.4 inches. As shown in FIG. 33D, the forearm segment 175' of the complementary glove 10 made by the forming device 170 is preferably connected to the hand covering portion (not shown). The forearm segment 177 is about 5.25 inches in length l24 to a center portion of notch 172, as shown in FIG. 33C.

Figure 34:
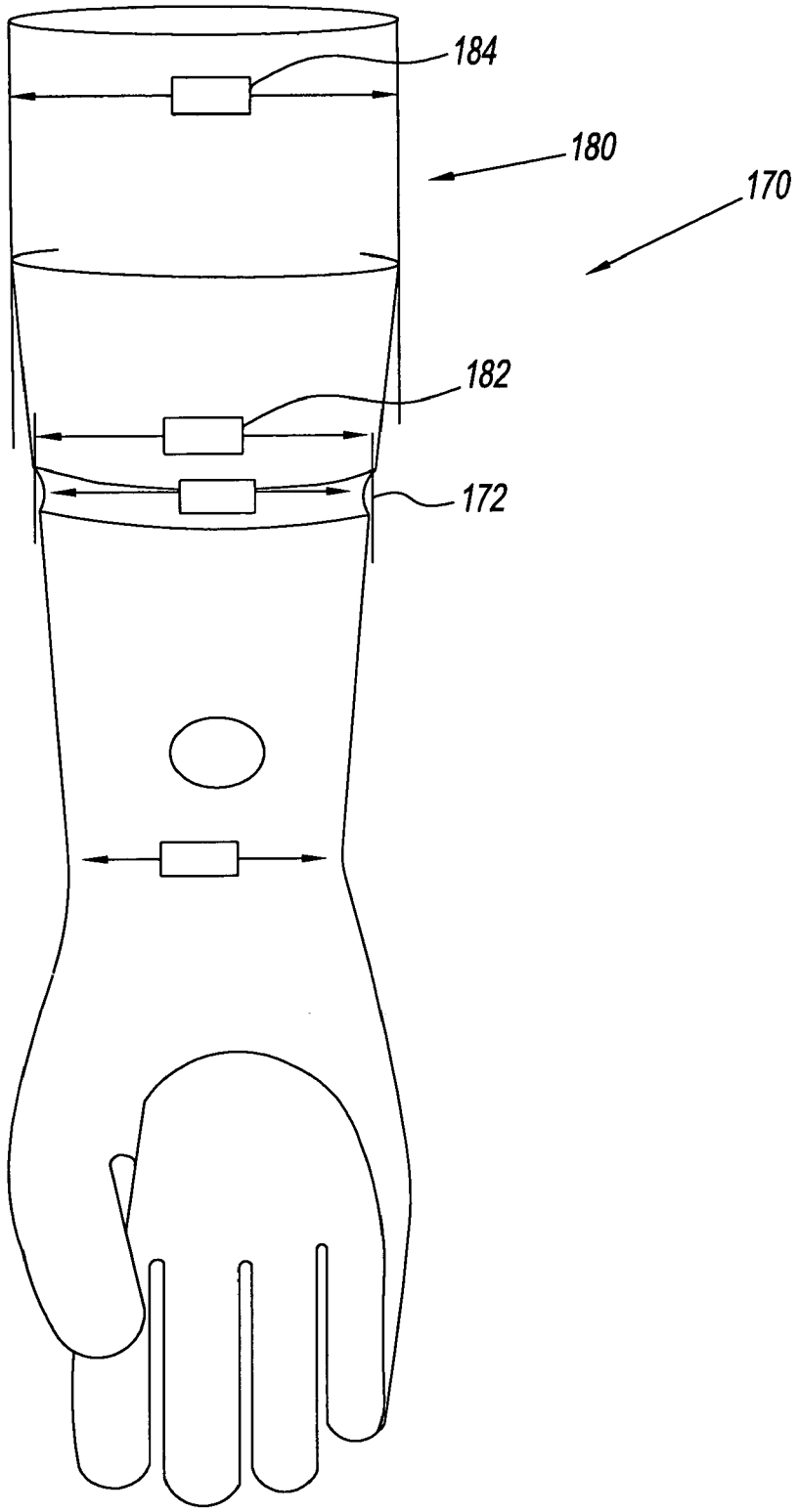
FIG. 34 is a side view of another glove forming device for manufacturing a glove having a cuffed portion according to the present invention.

FIG. 34 shows another embodiment of the glove forming device 170. In this embodiment, the glove forming device 170 has a "U" shaped notch 172 that has a height of about 0.3 inches. In this embodiment, the notch 172 is made as a shallow torsion collar with a longer cuffed portion 180. In this embodiment, the cuff portion 180 has a width at the initial point 182 of about 3.3 inches and at a wider second point 184 at about 3.8 inches.

Figures 35, 36:
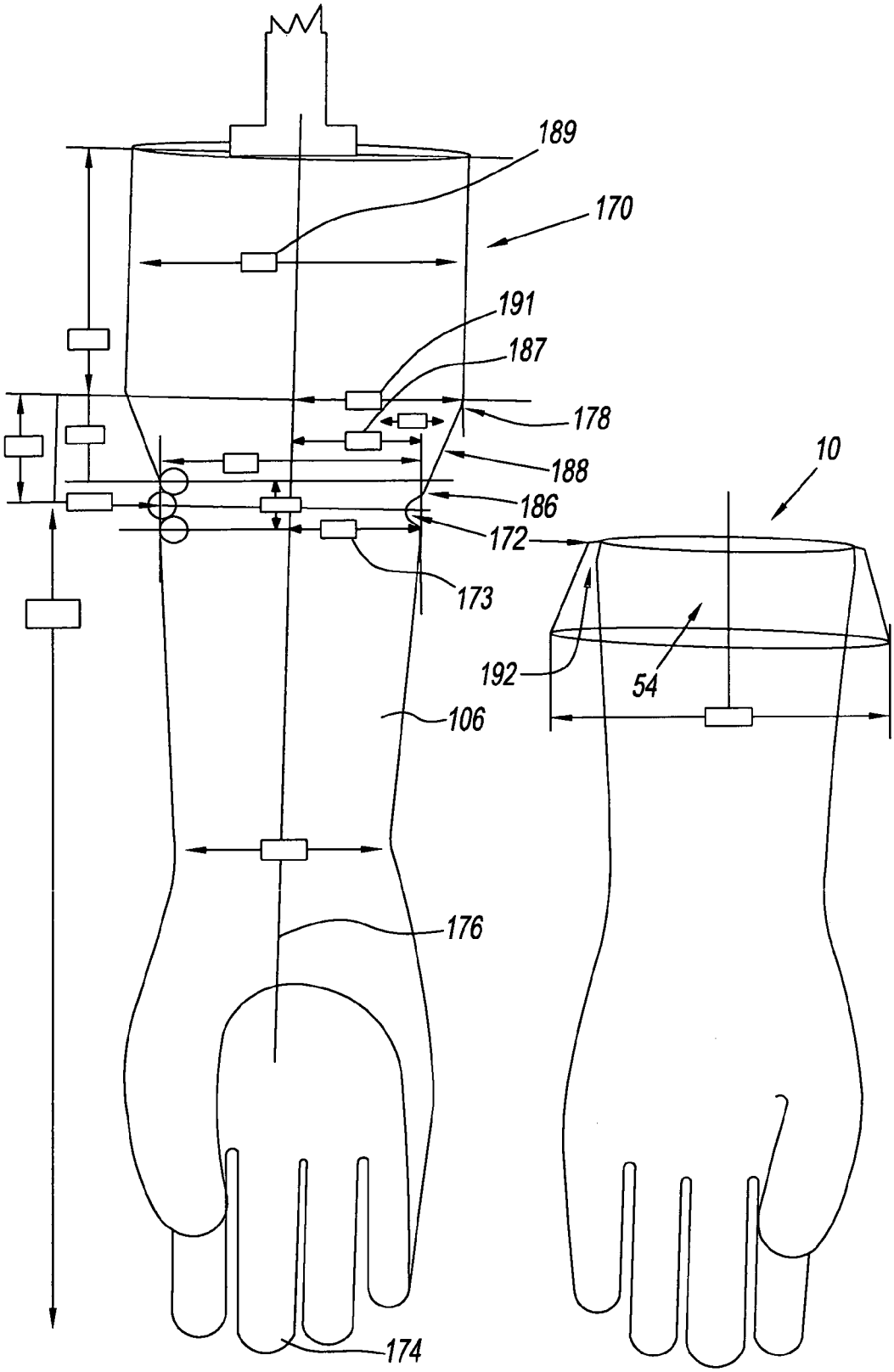
FIG. 35 is a side view of yet another glove forming device with a flare for manufacturing the glove having a cuffed portion according to the present invention.
FIG. 36 is a side view of a glove having a cuffed portion and a narrow channel being made from the glove forming device of FIG. 35.

Referring to FIG. 35, there is shown another embodiment of the glove forming device 170. In this embodiment, the glove forming device 170 has a "U" shaped notch 172 or fold indicator. The "U" shaped notch 172 has a center portion that is about 12 inches from the tip of a finger portion 174. The notch has a radius 173 of about 1.6 inches adjacent to a forearm segment 106. The notch 172 preferably has a prominent outer edge 186. The notch has a diameter of about 0.35 inches or a radius of curvature of about 0.175 inches curving inward toward a centerline 176 and preferably is about 0.5 inches to about 0.65 inches in length, and more preferably about 0.65 inches in length. The glove forming device 170 then extends outward from the prominent outer edge 186 and opposite the centerline 176 to form a prominent flare 188. The prominent flare 188 has a height of about 1.5 inches from the center portion of the notch 172 having a smallest diameter. The prominent flare has a diameter 187 of about 3.2 inches adjacent to the notch 172 and a diameter 189 of about 4.2 inches to about 4.3 inches, and more preferably of about 4.2 inches, at an end opposite the notch 172. The glove forming device 170 preferably has a radius 191 of about 2.1 inches or a diameter of about 4.2 inches from the prominent flare 188 up to a top edge of the glove forming device 170 opposite the prominent flare 188. The glove forming device 170 preferably has a length of about 3.5 inches from the prominent flare 188 up to the top edge of the glove forming device 170 opposite the prominent flare 188. Alternatively, the glove forming device 170 may further have the flare 188 extending outward from an outer surface 178 of the glove forming device 170 to form a bead trap member. The bead trap member may be a prominent extension or point that juts out from the outer surface 178 of the glove forming device 170.

Referring to FIG. 36, when the glove 10 having the cuffed portion 54 is made by the glove forming device of FIG. 36 is folded over to form the cuffed portion as shown, to forms a narrow channel 192. The narrow channel 192 allows a predetermined amount of liquid to rest therein. This narrow channel 192 is advantageous because prior art gloves usually have an intersection of two very smooth outer surfaces that prevents liquid to rest therein. However, this embodiment allows for an increased amount of liquid to be retained in the cuffed portion 54 of the glove 10. Alternatively, the bead trap member may likewise fold to further define the narrow channel 192.

Figure 37:
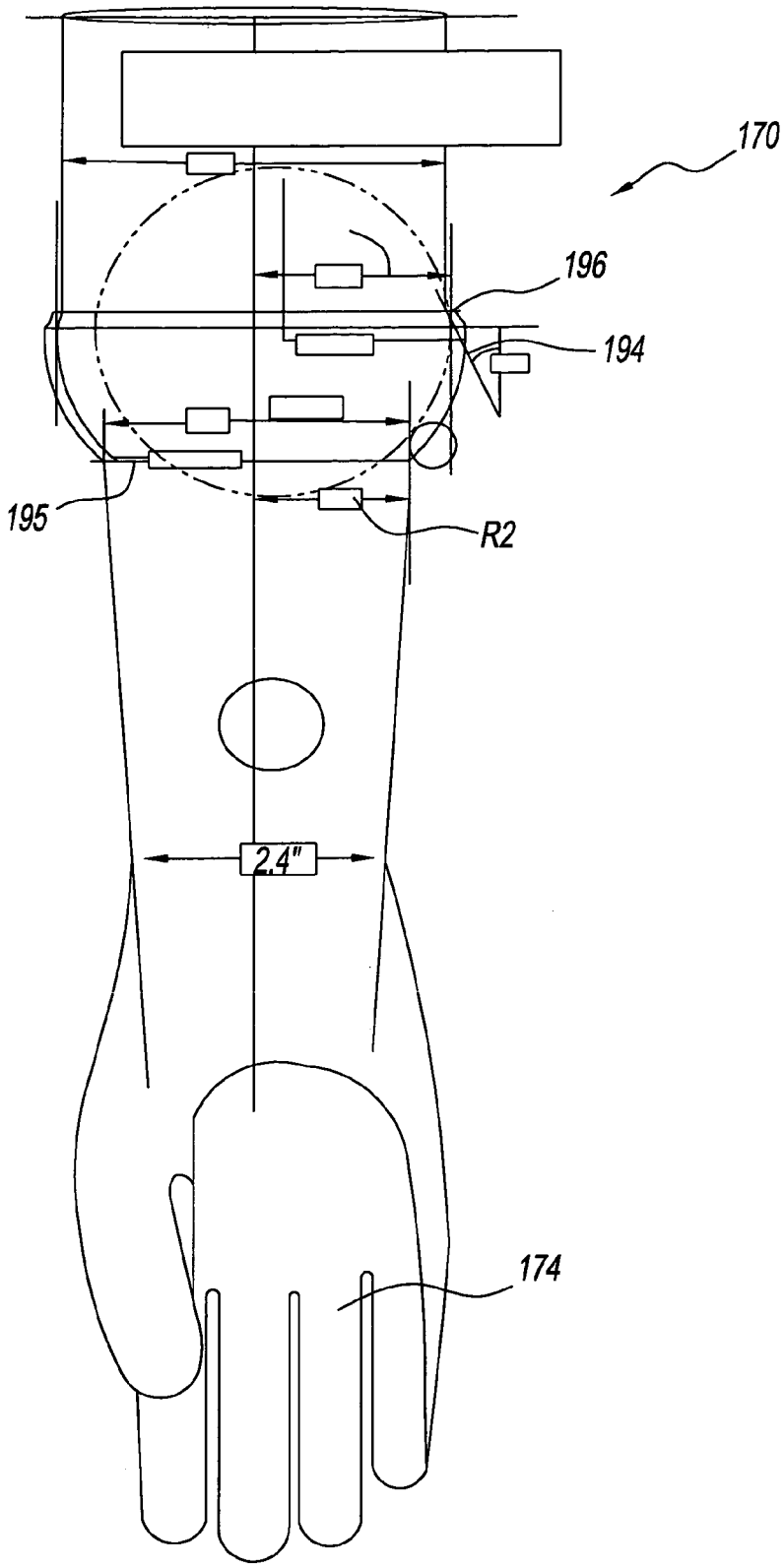
FIG. 37 is a side view of still another glove forming device with a bulbous portion for manufacturing a glove having a cuffed portion according to the present invention.

Referring to FIG. 37, there is shown another embodiment of the glove forming device 170. In this embodiment, the glove forming device 170 has a bulbous portion 194 with a radius of about 1.875 inches. The bulbous portion 194 terminates at a predetermined point 196 on the glove forming device 170. The bulbous portion 194 provides the user with the fold indicator 195 as to where to fold the bulbous portion to form the cuffed portion 54 of the glove 10. The glove forming device 170 has a radius R1 of about 2.05 inches in a location above and adjacent to the bulbous portion 194. The glove forming device 170 further has a radius R2 of about 1.6 inches below and adjacent to the bulbous portion 194 or in a direction toward the finger portion 174.

Figure 38:
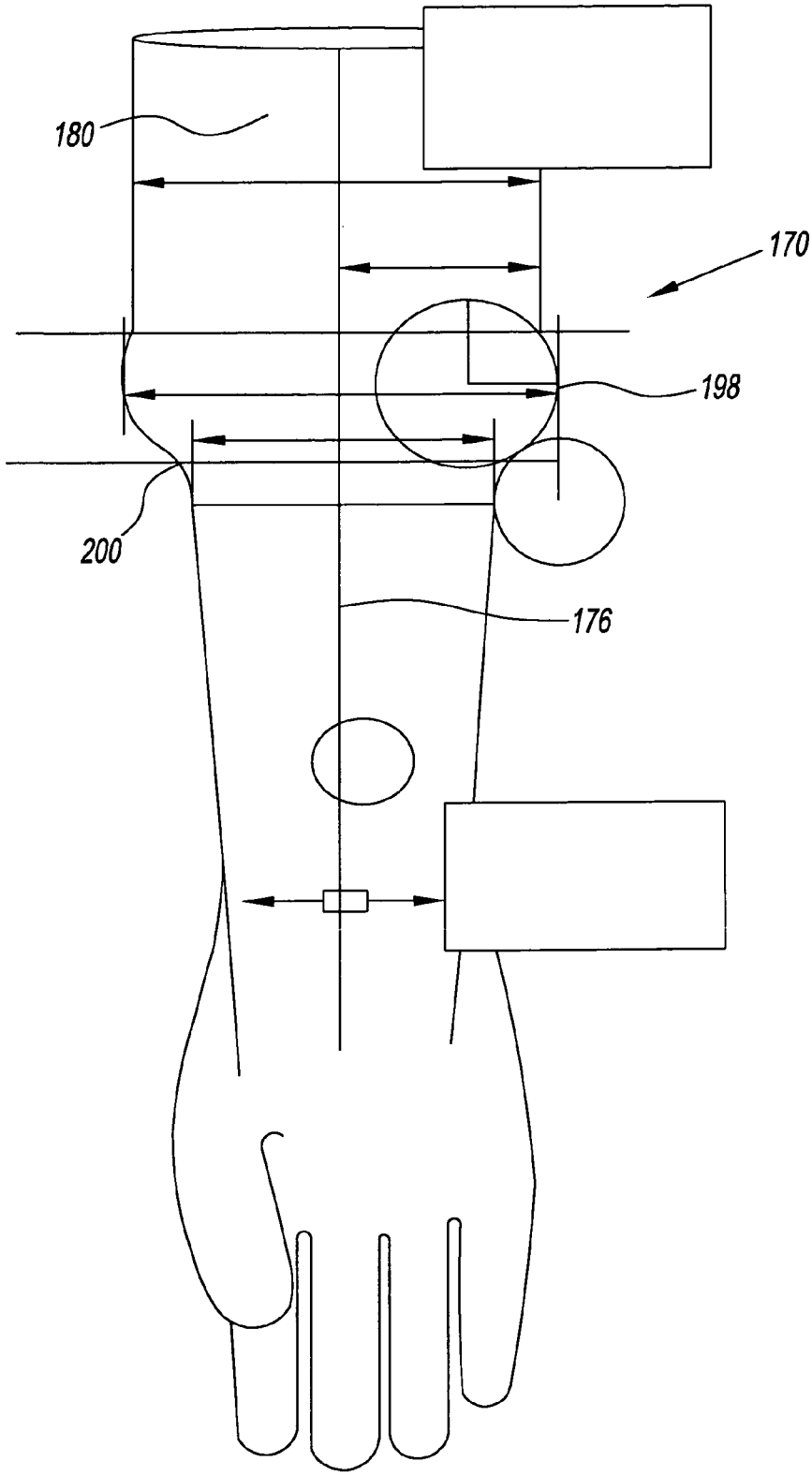
FIG. 38 is a side view of another glove forming device with a bulbous portion for manufacturing a glove having a cuffed portion according to the present invention.

Referring to FIG. 38, the glove forming device 170 has a rounded flare 198. The glove forming device 170 at the rounded flare 198 preferably has a diameter of about 4.8 inches at an outermost edge measured from end to end. Below, the rounded flare 198, the glove forming device 170 has a noticeable fold line 200 where the glove forming device has a diameter preferably of about 3.2 inches. At the fold line 200, the glove forming device has a radius of about 1.6 inches that is smaller than that of the rounded flare 198 to indicate the location below the rounded flare where to form the cuffed portion 180. Directly above the rounded flare 198, the glove forming device 170 has a radius of about 2.2 inches.

Figure 39:
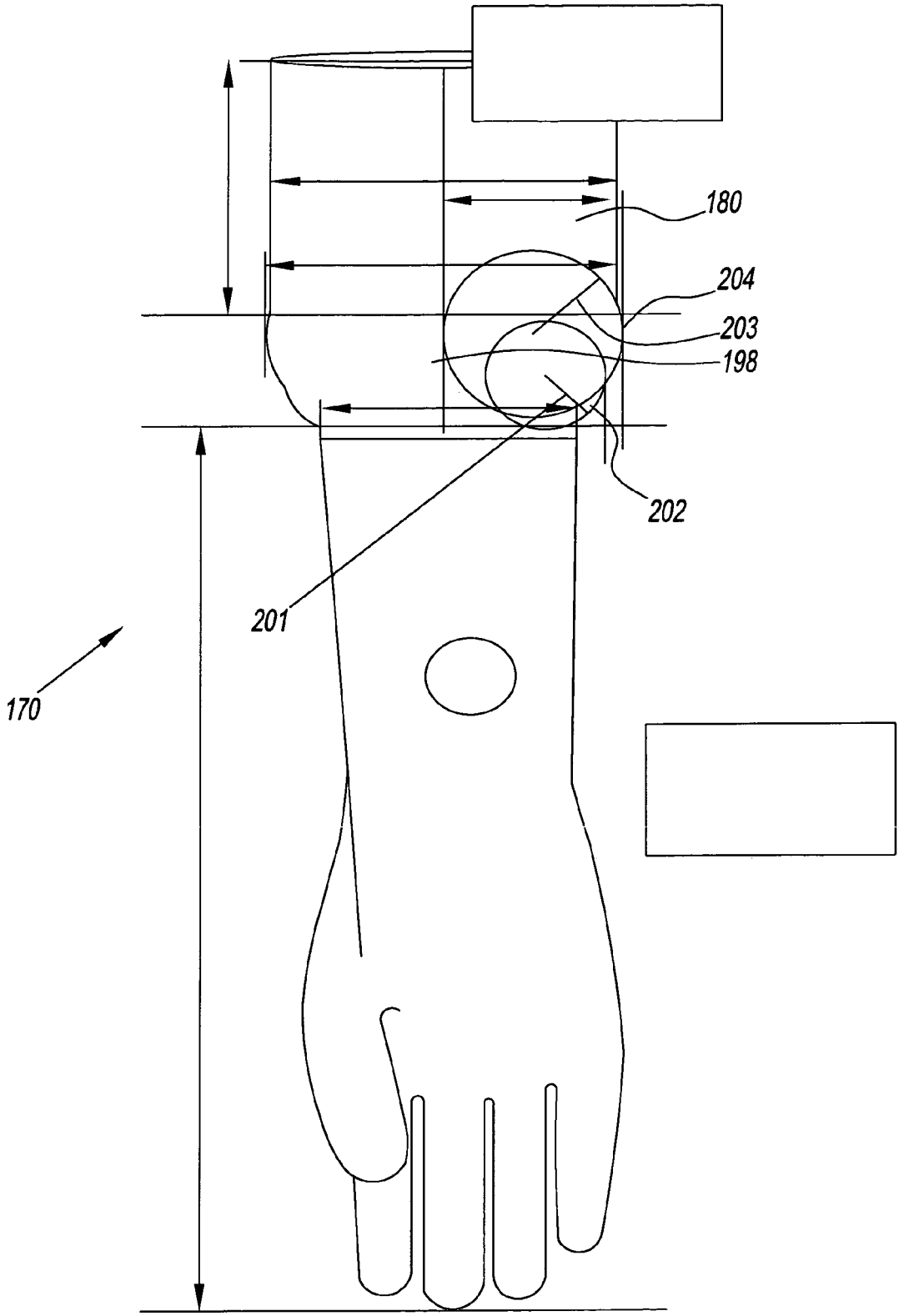
FIG. 39 is a side view of yet another glove forming device with a bulbous portion for manufacturing a glove having a cuffed portion according to the present invention.

Referring to FIG. 39, the glove forming device 170 has a rounded flare 198. In this embodiment, the glove forming device 170 has a diameter located above the rounded flare 198 of about 4.5 inches. Preferably, the rounded flare 198 has a first curvature 202 with a height of about 0.5 inches and a second curvature 204 with another second height of about 1 inch. The first curvature 202 has a radius 201 of about 0.75 inches and the second curvature 204 has another radius 203 of about 1.125 inches. This preferably forms an irregularly shaped cuffed portion 180 when folded. Further, an intersection of the cuffed portion 180 with the rounded flare 198 has a slightly reduced width relative to the embodiment of FIG. 38.

Figure 40:
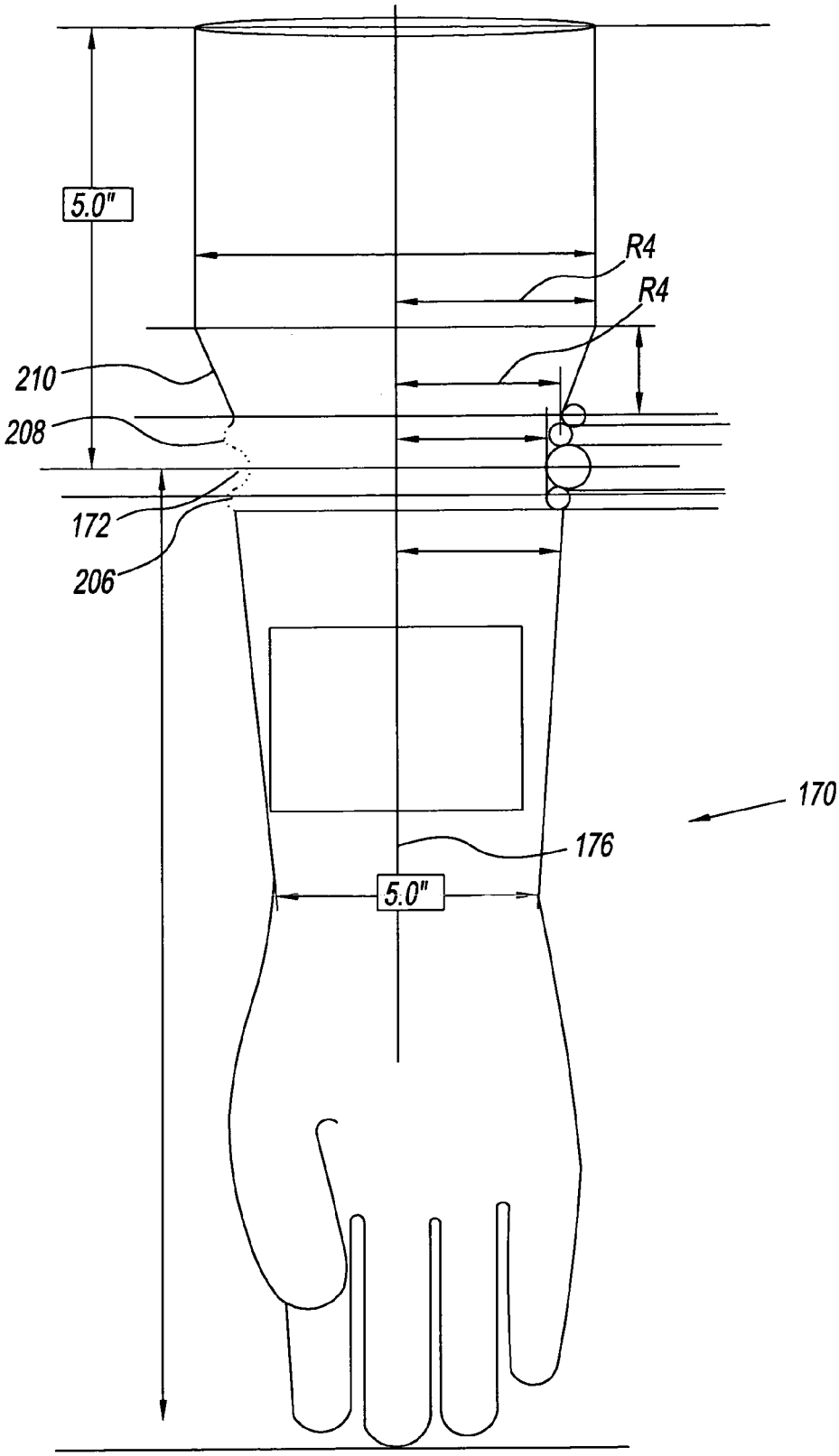
FIG. 40 is a side view of yet another glove forming device with a first bulbous portion and a second bulbous portion for manufacturing a glove with a cuffed portion according to the present invention.

Referring to FIG. 40, the glove forming device 170 has a first bulbous member 206 and an adjacent second bulbous member 208 with the notch 172 between the first and the second bulbous members. The notch 172 preferably forms a space with a diameter of about 0.5 inches. Each first bulbous member 206 and the second bulbous member 208 is curved outward opposite the centerline 176. Each first and second bulbous members 206, 208 has a diameter of 0.25 inches. As mentioned, the negative space of the notch 172 at an edge thereof forms a circular space with about a 0.5 inch diameter, however various sizes and geometries are possible. One skilled in the art should appreciate that the notch 172 should be prominent relative to the first and second bulbous members 206, 208 to provide the wearer with an indicator of an acceptable location to fold the glove 10. Disposed opposite the first and second bulbous members 206, 208, the glove forming device 170 has a diagonal shaped lateral side 210. At the diagonal shaped lateral side 210, the radius of the glove forming device 170 enlarges from about 1.7 inches at R3 to about 2 inches at R4.

Figure 41:
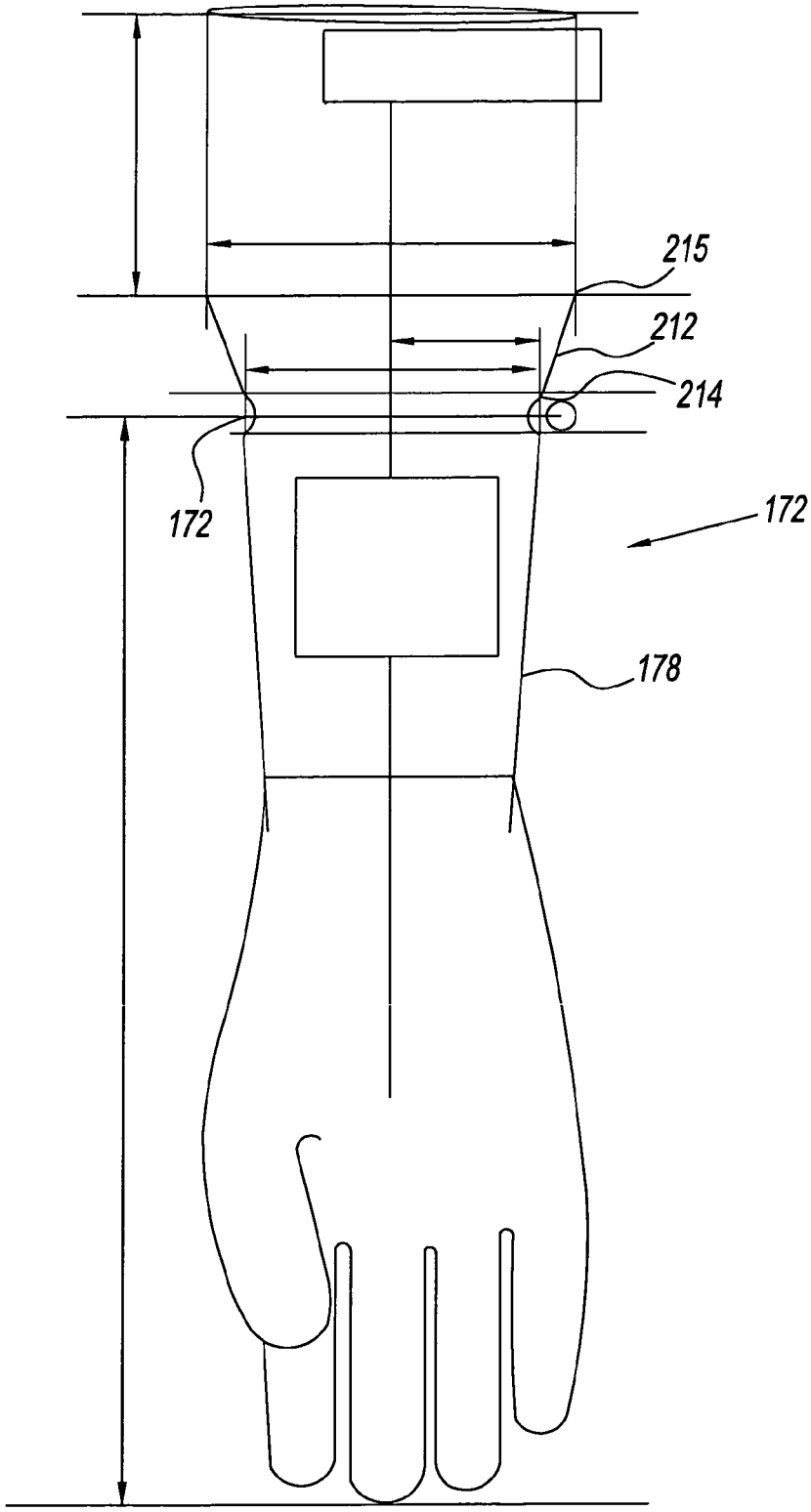
FIG. 41 is a side view of another glove forming device for manufacturing a glove with a cuffed portion according to the present invention.

Referring now to FIG. 41, the glove forming device 170 preferably has the notch 172 forming a substantially circular shaped negative space at the edge therefrom with the space having a diameter of about 0.35 inches. The notch 172 preferably has a height of about 0.5 inches and connects to a flare 212. The flare 212 extends outwardly about the outer surface 178 of the glove forming device 170. The glove forming device 170 at an initial point 214 of the flare 212 has a diameter of about 3.2 inches. The glove forming device then enlarges to a diameter of about 4.0 inches at a second opposite end 215.

Figure 42:
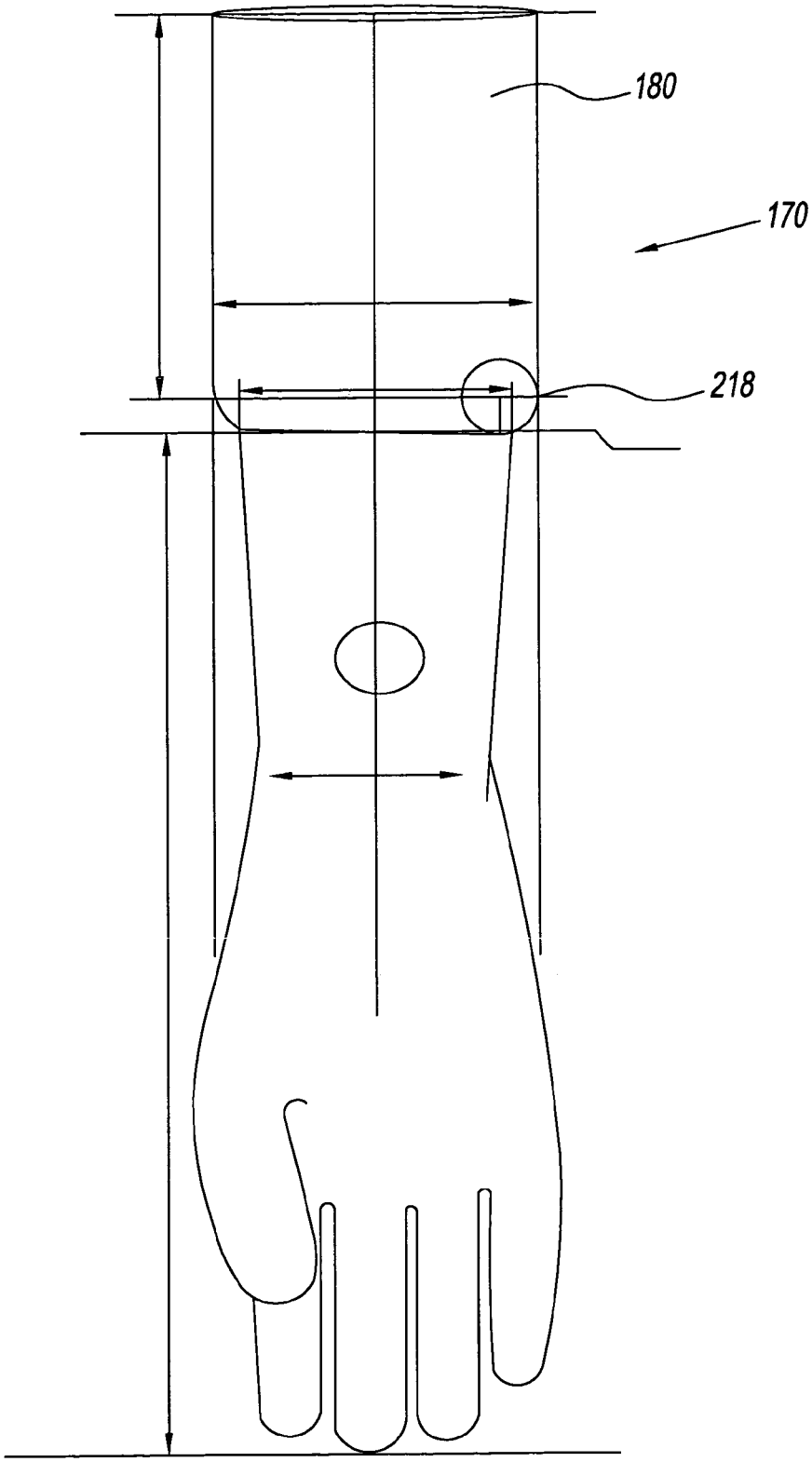
FIG. 42 is a side view of another glove forming device for manufacturing a glove with a cuffed portion according to the present invention.

Referring now to FIG. 42, the glove forming device 170 preferably has a first diameter of about 3.3 inches and expands at a rounded edge 218 to a diameter of about 3 inches. The rounded edge 218 preferably has a radius of about 0.5 inches. The rounded edge 218 preferably a tactile feedback of a location where to fold the cuffed portion 180 of the glove 10 manufactured by the glove forming device 170.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A glove for a wearer, the glove comprising:

a hand covering portion; and an arm covering portion being connected to said hand covering portion, said arm covering portion having a first tubular section with a first diameter, said first tubular section being connected to a second tubular section, said second tubular section having a second diameter, wherein said second diameter is greater than said first diameter, and wherein said second tubular section forms an obstruction for deflecting and diverting liquid from said obstruction, wherein said arm covering portion has a "U"-shaped indentation extending around a periphery of the glove and protruding inward to reduce said first diameter of said first tubular section, said reduced first diameter for facilitating introduction of the wearer's arm in the glove and for gripping the wearer, and wherein said "U"-shaped indentation is adjacent to an expanded portion, wherein said expanded portion has a diameter which increases in a direction opposite said hand covering portion, wherein said expanded portion is adjacent to a tapered portion opposite said "U"-shaped indentation, and wherein said tapered portion has a diameter that decreases toward said second tubular portion.

2. The glove of claim 1, wherein said "U"-shaped indentation has a radius between about 1.6 to 1.625 inches, measured from a centerline through the center of the glove.

3. The glove of claim 1, wherein said "U"-shaped indentation forms a substantially circular space with a diameter of about 0.25 to about 0.375 inches.

4. A glove for a wearer, the glove comprising:

a hand covering portion; and an arm covering portion being connected to said hand covering portion, said arm covering portion having a first tubular section with a first diameter, said first tubular section being connected to a second tubular section, said second tubular section having a second diameter, wherein said second diameter is greater than said first diameter, and wherein said second tubular section forms an obstruction for deflecting and diverting liquid therefrom, and wherein said second tubular portion is a prominent flare that flares outward in a direction away from the glove and is adjacent to said prominent edge, and wherein said arm covering portion has a "U"-shaped indentation extending around a periphery of the glove and protruding inward to reduce said first diameter of said first tubular section, said reduced first diameter for facilitating introduction of the wearer's arm in the glove and for gripping the wearer, and wherein said "U" shaped indentation is adjacent a prominent edge.

5. The glove of claim 4, wherein said prominent flare is invertable, and wherein said "U" shaped indentation and said prominent edge form a narrow channel when said prominent flare is inverted to retain liquid therein.

* * * * *